US011427785B2

(12) United States Patent
Ozaki et al.

(10) Patent No.: US 11,427,785 B2
(45) Date of Patent: Aug. 30, 2022

(54) DETERGENT COMPOSITION FOR TEXTILE PRODUCTS

(71) Applicant: KAO CORPORATION, Tokyo (JP)

(72) Inventors: Takanori Ozaki, Tokyo (JP); Kosuke Tawa, Wakayama (JP); Takanori Saito, Tokyo (JP); Yuichiro Tase, Wakayama (JP)

(73) Assignee: KAO CORPORATION, Tokyo (JP)

( * ) Notice: Subject to any disclaimer, the term of this patent is extended or adjusted under 35 U.S.C. 154(b) by 210 days.

(21) Appl. No.: 16/764,425

(22) PCT Filed: Dec. 5, 2018

(86) PCT No.: PCT/JP2018/044692
§ 371 (c)(1),
(2) Date: May 15, 2020

(87) PCT Pub. No.: WO2019/111935
PCT Pub. Date: Jun. 13, 2019

(65) Prior Publication Data

US 2020/0354650 A1 Nov. 12, 2020

(30) Foreign Application Priority Data

Dec. 6, 2017 (JP) ..... JP2017-234466

(51) Int. Cl.

| | |
|---|---|
| ***C11D 1/14*** | (2006.01) |
| ***C11D 1/72*** | (2006.01) |
| ***C11D 1/722*** | (2006.01) |
| ***C11D 1/83*** | (2006.01) |
| ***C11D 3/22*** | (2006.01) |
| ***C11D 3/37*** | (2006.01) |
| ***B08B 3/04*** | (2006.01) |
| ***C11D 11/00*** | (2006.01) |

(52) U.S. Cl.
CPC ..... *C11D 1/143* (2013.01); *C11D 1/722* (2013.01); *C11D 1/83* (2013.01); *C11D 3/222* (2013.01); *C11D 3/3707* (2013.01); *C11D 3/3715* (2013.01); *C11D 3/3723* (2013.01); *C11D 11/0017* (2013.01)

(58) Field of Classification Search
CPC ..... C11D 1/143; C11D 1/72; C11D 1/722; C11D 1/83; C11D 3/22; C11D 3/227; C11D 3/3707; C11D 3/3715; C11D 3/3723; C11D 11/0017; B08B 3/04
See application file for complete search history.

(56) References Cited

U.S. PATENT DOCUMENTS

| | | | | |
|---|---|---|---|---|
| 6,803,355 | B1 | 10/2004 | Panandiker et al. | |
| 10,947,479 | B2 * | 3/2021 | Yamada | C11D 1/14 |
| 11,053,456 | B2 * | 7/2021 | Ozaki | C11D 1/14 |
| 11,124,743 | B2 * | 9/2021 | Morikawa | C11D 3/43 |
| 2002/0042354 | A1 | 4/2002 | Lang et al. | |
| 2010/0261634 | A1 | 10/2010 | Misske et al. | |
| 2014/0079658 | A1 * | 3/2014 | Terazaki | A61K 8/4913 424/70.11 |
| 2015/0202134 | A1 | 7/2015 | Yoshikawa et al. | |
| 2015/0239993 | A1 * | 8/2015 | Miyoshi | A61Q 5/065 424/70.13 |
| 2018/0371360 | A1 * | 12/2018 | Doi | A61K 8/46 |
| 2019/0016992 | A1 * | 1/2019 | Doi | C11D 1/65 |
| 2020/0048582 | A1 | 2/2020 | Morikawa et al. | |
| 2020/0190432 | A1 | 6/2020 | Morikawa et al. | |
| 2020/0308512 | A1 | 10/2020 | Morikawa et al. | |
| 2020/0318032 | A1 | 10/2020 | Yamada | |

FOREIGN PATENT DOCUMENTS

| | | | |
|---|---|---|---|
| CN | 101855272 | A | 10/2010 |
| CN | 104736570 | A | 6/2015 |
| CN | 105142731 | A | 12/2015 |
| CN | 109154129 | A | 1/2019 |
| CN | 109196082 | A | 1/2019 |
| CN | 109863269 | A | 6/2019 |
| CN | 111032842 | A | 4/2020 |
| DE | 19725508 | A1 | 12/1998 |
| EP | 2 899 257 | A1 | 7/2015 |
| EP | 3010591 | B1 | 4/2017 |
| GB | 1 537 288 | | 12/1978 |
| JP | 51-142007 | | 12/1976 |

(Continued)

OTHER PUBLICATIONS

Chinese Office Action and Search Report for Chinese Application No. 201880074801.9, dated Aug. 18, 2021, with English translation.
Russian Office Action end Search Report for Russian Application No. 2020120947, dated Sep. 1, 2021, with English translation.
Extended European Search Report for European Application No. 18886158.7, dated Jul. 9, 2021.
International Search Report, issued in PCT/JP2018/044692, dated Jan. 29, 2019.

(Continued)

*Primary Examiner* — Brian P Mruk

(74) *Attorney, Agent, or Firm* — Birch, Stewart, Kolasch & Birch, LLP

(57) ABSTRACT

The present invention is a detergent composition for textile products, containing the following component (A) and the following component (B):

component (A): an internal olefin sulfonate with 16 or more and 24 or less carbons, wherein a mass ratio between an internal olefin sulfonate (IO-1S) with 16 or more and 24 or less carbons having a sulfonate group present at position 2 or higher and position 4 or lower and an internal olefin sulfonate (IO-2S) with 16 or more and 24 or less carbons having a sulfonate group present at position 5 or higher, which is (IO-2S)/(IO-1S), is 0.30 or more and 5 or less; and component (B): a soil release agent.

19 Claims, No Drawings

(56) References Cited

FOREIGN PATENT DOCUMENTS

| | | | | | |
|---|---|---|---|---|---|
| JP | 2001-172673 | A | | 6/2001 | |
| JP | 2002-504948 | A | | 2/2002 | |
| JP | 2002-536535 | A | | 10/2002 | |
| JP | 2003-81935 | A | | 3/2003 | |
| JP | 2004-189937 | A | | 7/2004 | |
| JP | 2014-77126 | A | | 5/2014 | |
| JP | 2015-28123 | A | | 2/2015 | |
| RU | 2 142 981 | C1 | | 12/1999 | |
| WO | WO 95/07971 | A1 | | 3/1995 | |
| WO | WO 2014/046301 | A2 | | 3/2014 | |
| WO | WO 2014/203548 | A1 | | 12/2014 | |
| WO | WO 2016/077207 | A1 | | 5/2016 | |
| WO | WO 2017/098638 | | * | 6/2017 | ..... C11D 1/14 |
| WO | WO 2017/098639 | | * | 6/2017 | ..... C11D 1/12 |

OTHER PUBLICATIONS

Stapersma et al., "Hydroxy Alkane Sulfonate (HAS), a New Surfactant Based on Olefins", J. Am. Oil Chem. Soc., Jan. 1992, vol. 69, No. 1, pp. 39-43.

Chinese Office Action and Search Report, dated Feb. 3, 2021, for Chinese Application No. 201880074801.9, with an English translation of the Chinese Office Action.

English translation of the International Preliminary Report on Patentability and Written Opinion of the International Searching Authority dated Jun. 18, 2020, for International Application No. PCT/JP2018/044692.

* cited by examiner

DETERGENT COMPOSITION FOR TEXTILE PRODUCTS

FIELD OF THE INVENTION

The present invention relates to a detergent composition for textile products and a method for washing textile products.

BACKGROUND OF THE INVENTION

It has been known that soil release agents are used in detergents for textile products. Soil release agents may also be referred to as soil releasing agents. Soil release agents have been known as agents which can be attached in advance to textile products before the textile products are used, e.g., worn, thereby further promoting, even if soil is attached to the textile products during use, the desorption of the soil from the textile products with washing after use.

JP-A 2001-172673 discloses a soil releasing agent including a monosaccharide unit having a particular cationic group, and a detergent containing the soil releasing agent. JP-A S51-142007 discloses a detergent composition which contains an anionic surfactant and a nonionic surfactant at a particular weight ratio, a soil releasable ether component selected from particular cellulose ethers, and an optional detergent builder component, the composition providing excellent washing performance for clothes.

Meanwhile, internal olefin sulfonates, which uses, as raw materials, internal olefins having a double bond not at the end of the olefin chain but inside thereof, have been widely used as household and industrial detergent components. JP-A 2015-28123 and JP-A 2014-77126 disclose internal olefin sulfonate compositions with excellent foamability and the like, the compositions containing an internal olefin sulfonate with 16 carbons and an internal olefin sulfonate with 18 carbons at a particular ratio and having a particular ratio of hydroxy form/olefin form.

SUMMARY OF THE INVENTION

The present invention provides a detergent composition for textile products with excellent washability for the soil attached to textile products, especially textile products including chemical fibers.

The present invention relates to a detergent composition for textile products, containing the following component (A) and the following component (B):

component (A): an internal olefin sulfonate with 16 or more and 24 or less carbons, wherein a mass ratio between an internal olefin sulfonate (IO-1S) with 16 or more and 24 or less carbons having a sulfonate group present at position 2 or higher and position 4 or lower and an internal olefin sulfonate (IO-2S) with 16 or more and 24 or less carbons having a sulfonate group present at position 5 or higher, which is (IO-2S)/(IO-1S), is 0.30 or more and 5 or less; and component (B): a soil release agent.

The present invention also relates to a method for washing textile products, including washing textile products with a detergent liquid containing the above detergent composition for textile products of the present invention and water, wherein the content of component (A) in the above detergent liquid is 0.005% by mass or more and 1% by mass or less and the content of component (B) in the above detergent liquid is 0.1 mg/kg or more and 800 mg/kg or less.

According to the present invention, a detergent composition for textile products with excellent washability for the soil attached to textile products, especially textile products including chemical fibers can be obtained.

EMBODIMENTS OF THE INVENTION

<Detergent Composition for Textile Products>

The present inventors have found that the soil removing effect produced by soil release agents can be further enhanced by using, along with soil release agents, an internal olefin sulfonate with 16 or more and 24 or less carbons, wherein a mass ratio between an internal olefin sulfonate (IO-1S) with 16 or more and 24 or less carbons having a sulfonate group present at position 2 or higher and position 4 or lower and an internal olefin sulfonate (IO-2S) with 16 or more and 24 or less carbons having a sulfonate group present at position 5 or higher, which is (IO-2S)/(IO-1S), is 0.30 or more and 5 or less. It had been theretofore unknown that the bonding positions of sulfonate groups in internal olefin sulfonates cause a difference in washability of the detergent composition for textile products formulated with internal olefin sulfonates and soil release agents.

<Component (A)>

Component (A) of the present invention is an internal olefin sulfonate with 16 or more and 24 or less carbons, wherein a mass ratio between an internal olefin sulfonate (IO-1S) with 16 or more and 24 or less carbons having a sulfonate group present at position 2 or higher and position 4 or lower and an internal olefin sulfonate (IO-2S) with 16 or more and 24 or less carbons having a sulfonate group present at position 5 or higher, which is (IO-2S)/(IO-1S), is 0.30 or more and 5 or less, and serves to further enhance the effect of soil release agents desorbing from textile products the soil attached to fibers thereof. In general, anionic surfactants may adsorb onto even textile products in a detergent liquid and may decrease a proportion of adsorbing onto the soil attached to textile products. It is assumed that the larger a content proportion of internal olefin sulfonate (IO-2S) with 16 or more and 24 or less carbons having a sulfonate group present at position 5 or higher in component (A) of the present invention is, the more component (A) selectively adsorbs onto the soil attached to textile products, especially textile products including chemical fibers, and thus, the soil is modified to be in a condition of easily desorb into a detergent liquid, and the soil releasability of component (B) is further enhanced.

Component (A) can be obtained by sulfonating an internal olefin with 16 or more and 24 or less carbons. Component (A) is an internal olefin sulfonate with 16 or more and 24 or less carbons. The above internal olefin refers to an olefin having a double bond at position 2 or inner. The internal olefin can be obtained by, for example, isomerizing a 1-olefin obtained by dehydrating a 1-alcohol. When the internal olefin is sulfonated, β-sultone is produced quantitatively and part of β-sultone is changed to γ-sultone and an olefin sulfonic acid, which are further converted into a hydroxyalkane sulfonate and an olefin sulfonate during the process of neutralization and hydrolysis (for example, J. Am. Oil Chem. Soc. 69, 39 (1992)). Here, the hydroxy group of the obtained hydroxyalkane sulfonate is positioned inside the alkane chain and the double bond of the olefin sulfonate is positioned inside the olefin chain. In addition, while the obtained product is mostly a mixture of them, it may include, in some cases, a trace amount of hydroxyalkane sulfonate having a hydroxy group at the end of its carbon chain or α-olefin sulfonate having a double bond at the end of its carbon chain. In the present specification, each of those products and a mixture thereof are collectively referred to as an internal olefin sulfonate (component (A)). In addition, the hydroxyalkane sulfonate is referred to as a hydroxy form (hereinafter, also referred to as HAS) of the internal olefin sulfonate and the olefin sulfonate is referred to as an olefin form (hereinafter, also referred to as IOS) of the internal olefin sulfonate.

Then, component (A) includes an internal olefin sulfonate (IO-1S) with 16 or more and 24 or less carbons having a sulfonate group present at position 2 or higher and position 4 or lower and an internal olefin sulfonate (IO-2S) with 16 or more and 24 or less carbons having a sulfonate group present at position 5 or higher, wherein a mass ratio of (IO-2S)/(IO-1S) is 0.30 or more and 5 or less.

(IO-2S)/(IO-1S), a mass ratio of a content of (IO-2S) to a content of (IO-1S) in component (A) is, from the viewpoint of selectively adsorbing onto soil, thereby modifying the soil to be in a condition of easily desorb into a detergent liquid and further enhancing the soil releasability of component (B), and thus, further enhancing the washability for the soil attached to textile products including chemical fibers, 0.30 or more, preferably 0.35 or more, more preferably 0.40 or more, further preferably 0.50 or more, furthermore preferably 0.60 or more, furthermore preferably 0.70 or more, furthermore preferably 0.80 or more, furthermore preferably 0.90 or more and furthermore preferably 1.0 or more, and 5 or less, preferably 4 or less and more preferably 3 or less.

Note that a content of each compound having a sulfonate group at a different position in component (A) can be measured by a high performance liquid chromatography mass spectrometer (hereinafter, abbreviated as HPLC-MS). In the present specification, the content of each compound having a sulfonate group at a different position shall be determined as the mass ratio based on the HPLC-MS peak area of the compound having a sulfonate group at each position in the total HAS forms of component (A). Here, HAS is a hydroxyalkane sulfonate, i.e., a hydroxy form of the internal olefin sulfonate in the compounds produced by sulfonating the internal olefin sulfonic acid.

In the present invention, the content of internal olefin sulfonate (IO-1S) with 16 or more and 24 or less carbons having a sulfonate group present at position 2 or higher and position 4 or lower is expressed by a representative value of the numerical values based on the HPLC-MS peak areas of the sulfonates with 16 or more and 24 or less carbons having a sulfonate group present at position 2 or higher and position 4 or lower in the HAS forms with 16 or more and 24 or less carbons.

In addition, the content of internal olefin sulfonate (IO-2S) with 16 or more and 24 or less carbons having a sulfonate group present at position 5 or higher is expressed by a representative value of the numerical values based on the HPLC-MS peak areas of the sulfonates with 16 or more and 24 or less carbons having a sulfonate group present at position 5 or higher in the HAS forms with 16 or more and 24 or less carbons.

Note that the internal olefin sulfonates of component (A) include internal olefin sulfonate (IO-1S) with 16 or more and 24 or less carbons having a sulfonate group present at position 2 or higher and position 4 or lower and internal olefin sulfonate (IO-2S) with 16 or more and 24 or less carbons having a sulfonate group present at position 5 or higher. The maximum value of the bonding position of the sulfonate group in internal olefin sulfonate (IO-2S) differs depending on the number of carbons.

(IO-2S)/(IO-1S), a mass ratio for component (A), is based on component (A) finally obtained. For example, even if an internal olefin sulfonate is obtained by mixing internal olefin sulfonates in which mass ratio (IO-2S)/(IO-1S) is outside the above range, the obtained internal olefin sulfonate is considered as the internal olefin sulfonate of component (A) as long as mass ratio (IO-2S)/(IO-1S) thereof is within the above range.

The number of carbons in the internal olefin sulfonate of component (A) is 16 or more, and 24 or less, preferably 22 or less, more preferably 20 or less and further preferably 18 or less. Component (A) is preferably an internal olefin sulfonate with 16 carbons. That is, the detergent composition for textile products of the present invention preferably contains an internal olefin sulfonate with 16 carbons as component (A). Note that the number of carbons in the salt moiety is not included in the number of carbons in component (A). That is, the number of carbons in the olefin moiety is the number of carbons in component (A).

Examples of the salt of the internal olefin sulfonate include an alkali metal salt, an alkaline earth metal (1/2 atom) salt, an ammonium salt or an organic ammonium salt. Examples of the alkali metal salt include a sodium salt and a potassium salt. Examples of the organic ammonium salt include an alkanolammonium salt with 1 or more and 6 or less carbons.

Component (A) also include those containing a trace amount of so-called alpha$\alpha$-olefin sulfonate (hereinafter, also referred to as $\alpha$-olefin sulfonate) in which the position of the sulfonate is present at position 1 of the carbon chain. The content of the $\alpha$-olefin sulfonate in the internal olefin sulfonate is imposed a certain limit from the viewpoint of further improving the washability for the soil attached to textile products including chemical fibers, where the upper limit of the content is 10% by mass or less, more preferably 7% by mass or less, further preferably 5% by mass or less and furthermore preferably 3% by mass or less; and the content is preferably 0.01% by mass or more from the viewpoint of reducing production cost and improving productivity.

Component (A) of the present invention can be obtained by sulfonating an olefin with 16 or more and 24 or less carbons having a double bond present at position 2 or higher as a main component. When the internal olefin is sulfonated, $\beta$-sultone is produced quantitatively and part of $\beta$-sultone is changed to $\gamma$-sultone and an olefin sulfonic acid, which are further converted into a hydroxyalkane sulfonate and an olefin sulfonate during the process of neutralization and hydrolysis (for example, J. Am. Oil Chem. Soc. 69, 39 (1992)). Here, the hydroxy group of the hydroxyalkane sulfonate obtained is positioned inside the alkane chain and the double bond of the olefin sulfonate is positioned inside the olefin chain. In addition, while the obtained product is mostly a mixture of them, it may include, in some cases, a trace amount of hydroxyalkane sulfonate having a hydroxy group at the end of its carbon chain or olefin sulfonate having a double bond at the end of its carbon chain.

In the present specification, each of those products and a mixture thereof are collectively referred to as an internal olefin sulfonate (component (A)). In addition, the hydroxyalkane sulfonate is referred to as a hydroxy form (HAS) of the internal olefin sulfonate, and the olefin sulfonate is referred to as an olefin form (hereinafter, also referred to as IOS) of the internal olefin sulfonate.

Note that the mass ratio of the compounds in component (A) can be measured by high HPLC-MS. Specifically, the mass ratio can be determined from the HPLC-MS peak area of component (A).

<Component (B)>

Component (B) is a soil release agent. The term "soil release agent" may also be used to refer to a soil releasing agent. Soil release agents have been known as compounds which can be attached in advance to a textile product before the textile product is used, e.g., worn, thereby further promoting, even if soil is attached to the textile product during use, the desorption of the soil from the textile product with washing after use. A soil release agent is used as one of the components included in the detergent composition for textile products in the present invention, and thus, the soil release agent can be attached to a textile product at the same time that the textile product is washed, and that is efficient.

Examples of component (B) are not particularly limited as long as they can be adsorbed, after washing, onto textile products in the presence of component (A). Examples of component (B) include, for example, one or more soil release agents selected from: as component (b1), one or two or more of polysaccharide derivatives having one or more groups selected from a cationic group and a hydrocarbon group with 1 or more and 18 or less carbons; as component (b2), one or two or more of polymers having one or two units selected from an alkylene terephthalate unit and an alkylene isophthalate unit, and an oxyalkylene unit; and as component (b3), one or two or more of polyalkyleneimine polymers having a polyoxyalkylene group. Component (B) is preferably one or more soil release agents selected from component (b1).

[Component (b1): One or Two or More of Polysaccharide Derivatives Having One or More Groups Selected from a Hydrocarbon Group with 1 or More and 18 or Less Carbons and a Cationic Group]

Component (b1) is one or two or more of polysaccharide derivatives having one or more groups selected from a hydrocarbon group with 1 or more and 18 or less carbons and a cationic group.

Component (b1) of the present invention is characteristically a polysaccharide derivative in which one or more groups selected from a cationic group and a hydrocarbon group with 1 or more and 18 or less carbons are bonded, directly or via a linking group, to a group lacking a hydrogen atom of a hydroxyl group of a polysaccharide or a derivative thereof, which is a precursor compound of component (b). Note that the above phrase "one or more groups selected from a cationic group and a hydrocarbon group with 1 or more and 18 or less carbons are bonded, directly or via a linking group, to a group lacking a hydrogen atom of a hydroxyl group of a polysaccharide or a derivative thereof" does not encompass a bonding mode in which a cation atom of the cationic group, e.g., a nitrogen cation, is covalently bonded, in a direct manner, to the group lacking a hydrogen atom of a hydroxyl group of a polysaccharide or a derivative thereof, i.e., an oxygen atom.

Examples of the polysaccharide include, for example, one or more polysaccharides selected from cellulose, guar gum or starch. While component (b1) is a polysaccharide derivative, any polysaccharide derivative can be used as a precursor compound for obtaining this. That is, component (b1) may be a derivative of a polysaccharide derivative. Examples of the polysaccharide derivative which is a precursor compound of component (b1) include a polysaccharide derivative in which part of or all hydrogen atoms of hydroxyl groups in the above polysaccharide is/are substituted with a hydroxyalkyl group with 1 or more and 4 or less carbons (hereinafter, also referred to as a hydroxyalkyl-substituted product). The hydroxyalkyl group with 1 or more and 4 or less carbons is preferably a hydroxyalkyl group with preferably 2 or more and 4 or less carbons. Examples of the hydroxyalkyl group with 2 or more and 4 or less carbons include, for example, one or more groups selected from a hydroxyethyl group, a hydroxypropyl group and a hydroxybutyl group, and it is preferably one or more groups selected from a hydroxyethyl group and a hydroxypropyl group. Component (b1) may be a compound in which one or more groups selected from a hydrocarbon group with 1 or more and 18 or less carbons and a cationic group are introduced into a polysaccharide or polysaccharide derivative selected from: one or more polysaccharides selected from cellulose, guar gum or starch; or hydroxyalkyl-substituted products thereof.

In component (b1), examples of the polysaccharide derivative having a hydrocarbon group with 1 or more and 18 or less carbons include a polysaccharide derivative in which a hydrocarbon group with 1 or more and 18 or less carbons is bonded, directly or via a linking group [hereinafter, referred to as linking group (1) component], to a polysaccharide or a derivative thereof, which is a precursor compound of component (b1).

Examples of the above linking group (1) include one or more groups selected from: an alkyleneoxy group with 1 or more and 3 or less carbons which may have a hydroxy group; a polyoxyalkylene group in which the alkylene group is an alkylene group with 1 or more and 3 or less carbons; a carbonyl group; a carbonyloxy group; and an oxycarbonyl group. Single linking group (1) may be one of or a combination of a plurality of the above linking groups. In addition, the polysaccharide derivative may include one or a plurality of linking group(s).

In the present invention, when the above hydrocarbon group is linked to an oxygen atom of linking group (1), the number of carbons of the hydrocarbon group of component (b1) represents the number of carbons of the above hydrocarbon group bonded to the oxygen atom. When the above hydrocarbon group is linked via a carbonyl group, the acyl group is bonded in the structure thereof, and the number of carbons of the hydrocarbon group of component (b1) represents the number of carbons of the acyl group. Similarly, when the above hydrocarbon group is linked via a carbonyloxy group and an oxycarbonyl group, the numbers of carbons thereof are included. When a 1,2-epoxyalkane is used for introducing the hydrocarbon group into the polysaccharide or polysaccharide derivative, the number of carbons of the hydrocarbon group of component (b1) represents the number of carbons of the aliphatic hydrocarbon group bonded to the ether group generated from the epoxy group. The epoxy group moiety is linking group (1). For example, when 1,2-epoxytetradecane is used for introducing the hydrocarbon group into the polysaccharide or polysaccharide derivative, the number of carbons of the hydrocarbon group is 12. That is, the oxyethylene group, which is linking group (1), is bonded to a hydroxyl group of the polysaccharide or polysaccharide derivative, and the alkyl group with 12 carbons (dodecyl group) is bonded via the linking group. The same applies to the case where an alkyl glycidyl ether is used.

In component (b1), examples of the polysaccharide derivative having a hydrocarbon group with 1 or more and 18 or less carbons further include a polysaccharide derivative in which a hydrocarbon group with 1 or more and 18 or less carbons is bonded, directly or via linking group (1), preferably via linking group (1), to oxygen atoms lacking hydrogen atoms of part of or all hydroxyl groups of the above hydroxyalkyl-substituted product.

The hydrocarbon group with 1 or more and 18 or less carbons is preferable in that it can impart hydrophobicity to component (b1) and further improve the adsorptivity onto textile products, especially textile products including chemical fibers, thereby improving the property of textile products easily desorbing soil. From the viewpoint of easily removing the soil attached to textile products, the number of carbons in the hydrocarbon group with 1 or more and 18 or less carbons is preferably 2 or more, further preferably 4 or more, further preferably 6 or more, furthermore preferably 8 or more, furthermore preferably 10 or more and furthermore preferably 12 or more, and preferably 16 or less and more preferably 14 or less. In addition, from the viewpoint of, when soil is attached during use of textile products to which component (b1) is attached, making it easier to remove the soil along with component (b1) from the textile products in the subsequent washing operation, it is preferable that the number of carbons of the hydrocarbon group of component (b1) is nearly equal to the number of the furthest carbon from the carbon atom to which the hydrophilic group of component (A) is bonded in terms of removing component (b1) from the textile product along with the soil. The hydrocarbon group is preferably an aliphatic hydrocarbon group in terms of easily interacting with component (A).

In the polysaccharide derivative of component (b1) having a hydrocarbon group with 1 or more and 18 or less carbons, the substitution degree of the hydrocarbon group with 1 or more and 18 or less carbons is preferably 0.0001 or more, more preferably 0.001 or more and further preferably 0.005 or more from the viewpoint of interacting with the hydrocarbon group of component (A) and easily desorbing from textile products along with soil; and preferably 0.4 or less, more preferably 0.2 or less, further preferably 0.1 or less, furthermore preferably 0.08 or less and furthermore preferably 0.06 or less from the viewpoint of easily desorbing from textile products, especially textile products including chemical fibers.

In component (b1), examples of the polysaccharide derivative having one or more groups selected from cationic groups include a polysaccharide derivative in which a cationic group is bonded, via an alkylene group with 1 or more and 4 or less carbons which may include a hydroxy group, which is a linking group [hereinafter, referred to as linking group (2)], to a group lacking a hydrogen atom of a hydroxyl group of a polysaccharide or a derivative thereof, preferably the above hydroxyalkyl-substituted product, which is a precursor compound of component (b1).

The cationic group is preferably a group including a nitrogen cation and more preferably a quaternary ammonium group in terms of easily desorbing from textile products due to the interaction with component (A).

Linking group (2) is an alkylene group with 1 or more and 4 or less carbons which may include a hydroxy group. Examples of the alkylene group with 1 or more and 4 or less carbons include one or more alkylene groups selected from a linear alkylene group with 1 or more and 4 or less carbons which may include a hydroxy group and a branched alkylene group with 3 or more and 4 or less carbons which may include a hydroxy group.

When the cationic group is a quaternary ammonium group, examples of each of the three hydrocarbon groups bonded to the quaternary ammonium group other than linking group (2) independently include a linear hydrocarbon group with 1 or more and 4 or less carbons or a branched hydrocarbon group with 3 or more and 4 or less carbons. Examples of the linear hydrocarbon group with 1 or more and 4 or less carbons include a methyl group, an ethyl group, an n-propyl group and an n-butyl group. Examples of the branched hydrocarbon group with 3 or more and 4 or less carbons include an isopropyl group, a sec-butyl group, a tert-butyl group and an isobutyl group. The linear hydrocarbon group with 1 or more and 4 or less carbons is preferably a methyl group or an ethyl group.

Examples of the counter ion for the quaternary ammonium group include one or more counter ions selected from an alkyl sulfate ion with 1 or more and 3 or less carbons, a sulfate ion, a phosphate ion, a fatty acid ion with 1 or more and 3 or less carbons and a halide ion. Among these, one or more selected from an alkyl sulfate ion with 1 or more and 3 or less carbons, a sulfate ion and a halide ion are preferable, and a halide ion is more preferable, from the viewpoint of easiness of production and availability of raw materials. Examples of the halide ion include a fluoride ion, a chloride ion, a bromide ion and an iodide ion. From the viewpoint of the water solubility and chemical stability of the polysaccharide derivative of component (b1), it is preferably one or more selected from a chloride ion and a bromide ion, and more preferably a chloride ion. Note that the counter ion may be only one or may be two or more.

When the substitution degree of a cationic group is high in the polysaccharide derivative of component (b1) having the cationic group, component (A) having an anion group highly interacts with component (b1) having a cationic group during washing, and thus, component (A) and component (b1) having a cationic group become higher in hydrophobicity to lead a higher hydrophobicity than that of the water contained in a detergent liquid and hardly desorb from textile products. On the other hand, as textile products tend to have a negative charge in a detergent liquid and interact with component (b1) having a cationic group, the higher the value for the substitution degree of the cationic group of component (b1) including a cationic group is, the more the adsorptivity onto textile products is, and that is preferable. Furthermore, it is assumed that, if a number of moles of the cationic group of a soil release agent of component (b1) including a cationic group attached to a textile product is smaller than that of the anion group of component (A), the soil release agent is easily desorbed from textile products along with the soil during washing due to the interaction with the anionic group. In the present invention, it is preferable that the value for the substitution degree of the cationic group should be selected considering these viewpoints. The substitution degree of the cationic group of the polysaccharide derivative of component (b1) having a cationic group is, from the above viewpoints, preferably 0.001 or more, more preferably 0.005 or more and further preferably 0.01 or more, and preferably 1 or less, more preferably 0.7 or less, further preferably 0.4 or less, furthermore preferably 0.35 or less, furthermore preferably 0.3 or less, furthermore preferably 0.25 or less and furthermore preferably 0.2 or less.

In the present invention, the substitution degree of each of one or more groups selected from a hydrocarbon group with 1 or more and 18 or less carbons and a cationic group of component (b1) refers to the number of the group substituted per constituent monosaccharide unit, that is, the molar average substitution degree (MS). For example, when the polysaccharide is cellulose, the "substitution degree of a group" means an average number of moles of the group introduced into 1 mole of the anhydroglucose unit. The substitution degree of the cationic group and the substitution degree of the hydrocarbon group with 1 or more and 18 or less carbons in a polysaccharide derivative is each determined in the manner described in Examples.

Component (b1) may be a polysaccharide derivative having both a hydrocarbon group with 1 or more and 18 or less carbons and a cationic group. The substitution degree of each group in this case is as described above.

While component (b1) may also have an anionic group, the ratio of the substitution degree of the anionic group to the sum of the substitution degree of the cationic group and the substitution degree of the hydrocarbon group with 1 or more and 18 or less carbons in component (b1), which is the substitution degree of the anionic group/(the substitution degree of the cationic group+the substitution degree of the hydrocarbon group with 1 or more and 18 or less carbons), is preferably 3 or less, more preferably 1.7 or less, further preferably 1.5 or less, furthermore preferably 1 or less, furthermore preferably 0.5 or less and furthermore preferably 0.1 or less; and may be 0 or more, preferably 0, from the viewpoint of washing performance.

The weight average molecular weight of a polysaccharide or a derivative thereof, which is a precursor compound of component (b1) of the present invention, is preferably 1,000 or more, more preferably 10,000 or more, further preferably 30,000 or more, furthermore preferably 50,000 or more, furthermore preferably 70,000 or more, furthermore preferably 100,000 or more, furthermore preferably 300,000 or more and furthermore preferably 500,000 or more from the viewpoint of improving washing performance, and preferably 3 million or less and more preferably 2.5 million or less from the viewpoint of easiness of handling. This weight average molecular weight of the precursor compound can be calculated in polyethylene glycol terms by GPC (gel permeation chromatography).

Examples of component (b1) include a polysaccharide derivative in which one or more groups selected from a cationic group and a hydrocarbon group with 1 or more and 18 or less carbons are bonded, directly or via a linking group, to a group lacking a hydrogen atom of a hydroxyl group of a polysaccharide or a derivative thereof, which is a precursor compound, wherein:

when the cationic group is bonded to the group lacking a hydrogen atom of a hydroxyl group, it is bonded thereto directly or via linking group (2), and when the hydrocarbon group is bonded to the group lacking a hydrogen atom of a hydroxyl group, it is bonded thereto directly or via linking group (1); wherein linking group (1) is one or more groups selected from: an alkyleneoxy group with 1 or more and 3 or less carbons which may have a hydroxy group; a polyoxyalkylene group in which the alkylene group is an alkylene group with 1 or more and 3 or less carbons; a carbonyl group; a carbonyloxy group; and an oxycarbonyl group; and linking group (2) is an alkylene group with 1 or more and 4 or less carbons which may include a hydroxy group.

[Component (b2): A Polymer Having One or Two Units Selected from an Alkylene Terephthalate Unit and an Alkylene Isophthalate Unit, and an Oxyalkylene Unit]

Component (b2) of the present invention is a polymer having one or two units selected from an alkylene terephthalate unit and an alkylene isophthalate unit, and an oxyalkylene unit.

Examples of the alkylene terephthalate unit include one or more selected from an ethylene terephthalate unit, a propylene terephthalate unit and a butylene terephthalate unit, and among these, an ethylene terephthalate unit is preferable.

Examples of the alkylene isophthalate unit include one or more selected from an ethylene isophthalate unit, a propylene isophthalate unit and a butylene isophthalate unit, and among these, an ethylene isophthalate unit is preferable.

Examples of the polyoxyalkylene unit include one or more selected from a polyoxyethylene unit, a polyoxypropylene unit and a polyoxyethylene polyoxypropylene unit.

The molar ratio of the oxyalkylene unit to one or more units selected from the alkylene terephthalate unit and the alkylene isophthalate unit, (the number of moles of the oxyalkylene unit)/(the number of moles of one or more units selected from the alkylene terephthalate unit and the alkylene isophthalate unit) is, from the viewpoint of enabling further improvement in washing performance, preferably 0.6 or less, more preferably 0.5 or less and further preferably 0.4 or less, and preferably 0 or more and more preferably 0.1 or more.

The weight average molecular weight of component (b2) is, from the viewpoint of further improving adsorptivity onto textile products, thereby further improving washability for the soil attached to textile products after use, preferably 300 or more, more preferably 500 or more and further preferably 1000 or more, and preferably 20000 or less and more preferably 15000 or less. Note that the weight average molecular weight of component (b2) represents a value obtained by converting, based on the calibration curve in PEG (polyethylene glycol), a value measured by GPC (gel permeation chromatography) using THF (tetrahydrofuran) as a solvent.

[Component (b3): A Polyalkyleneimine Polymer Having a Polyoxyalkylene Group]

Component (b3) is a polyalkyleneimine polymer having a polyoxyalkylene group.

Examples of the oxyalkylene group of the polyoxyalkylene group include an oxyalkylene group with 2 or more and 3 or less carbons, specifically one or more groups selected from an oxyethylene group and an oxypropylene group. Examples of the alkylene group of the polyalkyleneimine include an alkylene group with 2 or more and 6 or less carbons. More specifically, examples thereof include one or more selected from an ethylene group and a butylene group having various bonding modes. It is preferable that the number of the polyoxyalkylene group bonded to the polyalkyleneimine should be preferably 3 or more and 100 or less polyoxyalkylene groups per active hydrogen of the polyalkyleneimine on average. From the viewpoint of further enhancing washability for the soil attached to textile products, the weight average molecular weight of the polyalkyleneimine polymer is preferably 300 or more, more preferably 500 or more and further preferably 1000 or more, and preferably 1 million or less, more preferably 500,000 or less and further preferably 100,000 or less.

<Fibers>

The Fibers constituting textile products to be washed with the detergent composition for textile products of the present invention may be either chemical fibers or natural fibers. Examples of the chemical fiber include, for example, a polyamide-based fiber (such as nylon), a polyester-based fiber (such as polyester), a polyacrylonitrile-based fiber (such as acrylic), a polyvinyl alcohol-based fiber (such as vinylon), a polyvinyl chloride-based fiber (such as polyvinyl chloride), a polyvinylidene chloride-based fiber (such as vinylidene), a polyolefin-based fiber (such as polyethylene and polypropylene), a polyurethane-based fiber (such as polyurethane) and a polyvinyl chloride/polyvinyl alcohol copolymer-based fiber (such as polychlal). Examples of the natural fiber include a seed hair fiber (such as cotton, arboreous cotton and kapok), a bast fiber (such as linen, flax, ramie, hemp and jute), a vein fiber (such as manila hemp and sisal hemp), coconut fiber, rush, straw, an animal hair fiber (such as wool, mohair, cashmere, camel hair, alpaca, vicuna and angora), a silk fiber (domesticated silkworm silk and wild silkworm silk), a feather and down and a cellulosic fiber (such as rayon, polynosic, cupra and acetate). The Fibers with which the present invention deals are preferably chemical fibers.

<Textile Products>

In the present invention, textile products refers to clothes such as a woven fabric, a knitted fabric or a nonwoven fabric using the above chemical fibers or natural fibers, and the products obtained by using the clothes, such as an undershirt, a T-shirt, a business shirt, a blouse, pants, a hat, a handkerchief, a towel, a knit, socks, an underwear and tights. As improvement in washability of a soil release agent used with component (A) of the present invention is more easily felt, the textile products are preferably textile products including chemical fibers. From the viewpoint of enabling further improvement in washability of the soil release agent by the combined use with component (A) of the present invention, the content of chemical fibers in the textile products is preferably 5% by mass or more, more preferably 10% by mass or more, further preferably 20% by mass or more, furthermore preferably 30% by mass or more and furthermore preferably 50% by mass or more, and furthermore preferably 100% by mass or less. The content of chemical fibers in the textile products may be 100% by mass.

<Composition and Others>

The detergent composition for textile products of the present invention may be (1) a detergent composition for textile products intended for use by diluting in water, i.e., a detergent composition for textile products used by diluting in water [hereinafter, referred to as detergent composition (1) for textile products], or may be (2) a detergent composition for textile products intended for use as-is as a detergent composition to wash textile products, i.e., a detergent composition for textile products used as-is as a detergent liquid without diluting [hereinafter, referred to as detergent composition (2) for textile products]. In the present specification, when the term "detergent composition for textile products" or "detergent composition for textile products of the present invention" is mentioned, it encompasses these detergent compositions (1) and (2) for textile products.

The content of component (A) in detergent composition (1) for textile products is 5% by mass or more, preferably 7% by mass or more and more preferably 10% by mass or more from the viewpoint of further improving the per-mass washability of detergent composition (1) for textile products when washing fibers, and preferably 60% by mass or less, more preferably 50% by mass or less and further preferably 40% by mass or less from the viewpoint of suppressing the deposition or separation of a solid in composition (1) under a low-temperature environment.

In addition, the content of component (A) in detergent composition (2) for textile products is preferably 0.005% by mass or more, more preferably 0.01% by mass or more and preferably 0.1% by mass or more from the viewpoint of further improving the washability when washing fibers, and preferably 1% by mass or less and more preferably 0.8% by mass or less from the viewpoint of economical efficiency.

Note that the content of component (A) contained in the detergent composition for textile products of the present invention such as detergent composition (1) for textile products or detergent composition (2) for textile products is based on the value calculated by converting the counter ion into a sodium ion. That is, it is a content in terms of a sodium salt.

In the present invention, the proportion of the internal olefin sulfonate of component (A) in the total anionic surfactants contained in the detergent composition for textile products is preferably 50% by mass or more, further 60% by mass or more, further 70% by mass or more and further 80% by mass or more, and 100% by mass or less.

The content of component (B) in detergent composition (1) for textile products of the present invention is, from the viewpoint of further enhancing the per-mass washability of detergent composition (1) for textile products for the soil attached to the fibers, preferably 0.1% by mass or more and more preferably 0.2% by mass or more, and preferably 10% by mass or less, more preferably 5% by mass or less, further preferably 3% by mass or less and furthermore preferably 1% by mass or less.

In addition, the content of component (B) in detergent composition (2) for textile products is preferably 0.1 mg/kg or more, more preferably 0.5 mg/kg or more, further preferably 1.0 mg/kg or more and furthermore preferably 3.0 mg/kg or more from the viewpoint of improving the washability when washing fibers, and preferably 800 mg/kg or less, more preferably 500 mg/kg or less, further preferably 100 mg/kg or less, furthermore preferably 50 mg/kg or less, furthermore preferably 30 mg/kg or less, furthermore preferably 10 mg/kg or less and furthermore preferably 5 mg/kg or less from the viewpoint of economical efficiency.

The detergent composition for textile products of the present invention may contain water. For example, in order to keep the property of the composition of the present invention at 4° C. or higher and 40° C. or lower in a liquid state, it can contain water. Deionized water (which may also be referred to as ion exchanged water), or ion exchanged water to which sodium hypochlorite in an amount of 1 mg/kg or more and 5 mg/kg or less is added can be used as the water. Tap water can also be used. The content of the water in the composition is preferably 10% by mass or more and more preferably 20% by mass or more, and preferably 90% by mass or less and more preferably 80% by mass or less.

<Optional Component>

The detergent composition for textile products of the present invention preferably contains a nonionic surfactant as component (C). In terms of cooperating with the above component (B) to enhance the washability for the soil attached to textile products, component (C) is preferably contained in the detergent composition for textile products of the present invention. Component (C) is preferably a nonionic surfactant having one or more groups selected from a hydroxyl group and a polyoxyalkylene group from the viewpoint of cooperating with component (B) to further enhance the washability for the soil attached to textile products. Component (C) is preferably a nonionic surfactant having a polyoxyalkylene group and having an HLB of 7 or more and 20 or less. From the viewpoint of further enhancing the washability for the soil attached to textile products by cooperation with component (B), a preferable HLB is 8 or more, more preferably 9 or more and further preferably 10 or more, and preferably 20 or less and more preferably 19 or less.

The HLB by Griffin's method is applied to the HLB of component (C) including a polyoxyethylene group, which is represented by the following formula:

$$HLB(\text{Griffin})=[(\text{molecular weight of polyoxyethylene group})/(\text{molecular weight of component (C)})]\times 20$$

In addition, the HLB by Davis's method is applied to the HLB of component (C) not including a polyoxyethylene group.

More specific examples of component (C) include a nonionic surfactant which has an HLB of preferably 7 or more, more preferably 8 or more, further preferably 9 or more and furthermore preferably 10 or more, and preferably 20 or less and more preferably 19 or less and which is represented by the following general formula (C):

$$R^1(CO)_mO—(A^1O)_n—R^2 \quad (C)$$

wherein $R^1$ is an aliphatic hydrocarbon group with 9 or more and 16 or less carbons; $R^2$ is a hydrogen atom or a methyl group; CO is a carbonyl group; m is a number of 0 or 1; $A^1O$ group is one or more groups selected from an ethyleneoxy group and a propyleneoxy group; and n is an average number of added moles and is a number of 3 or more and 50 or less.

In general formula (C), $R^1$ is an aliphatic hydrocarbon group with 9 or more and 16 or less carbons. The larger the number of carbons in $R^1$ is, the lower the value of HLB is, and the smaller the number of carbons in $R^1$ is, the higher the value of HLB is, as long as any other structures are the same. From the viewpoint of making it easier to remove the soil attached to textile products, the number of carbons in $R^1$ is 9 or more, preferably 10 or more and more preferably 11 or more, and preferably 18 or less, more preferably 16 or less, further preferably 15 or less and furthermore preferably 14 or less. Examples of the aliphatic hydrocarbon group of $R^1$ include a group selected from an alkyl group and an alkenyl group.

In general formula (C), $A^1O$ group is one or more groups selected from an ethyleneoxy group and a propyleneoxy group. When an ethyleneoxy group and a propyleneoxy group are included, the ethyleneoxy group and the propyleneoxy group may be bonded as a block type or a random type. From the viewpoint of further enhancing the soil releasability of component (B), $A^1O$ group is preferably a group including an ethyleneoxy group. The HLB value of the ethyleneoxy group is higher than that of the propyleneoxy group.

In general formula (C), n is an average number of added moles and is a number of 3 or more and 50 or less. The larger the number of n is, the higher the HLB value is, and the smaller the number of n is, the lower the HLB value is, as long as any other structures are the same. From the viewpoint of further enhancing the washability for the soil attached to products especially including chemical fibers by the cooperation with component (A) and component (B) of the present invention, n is preferably 4 or more, more preferably 5 or more and further preferably 6 or more.

When the detergent composition for textile products of the present invention contains component (C), the content of component (C) in the composition is preferably 1% by mass or more, more preferably 3% by mass or more, further preferably 5% by mass or more and furthermore preferably 10% by mass or more, and preferably 60% by mass or less, more preferably 50% by mass or less and further preferably 45% by mass or less.

When the detergent composition for textile products of the present invention contains component (C), the mass ratio (C)/(B) of the content of component (C) to the content of component (B) is preferably 2 or more, more preferably 10 or more, further preferably 20 or more and furthermore preferably 30 or more, and preferably 100 or less, more preferably 90 or less and further preferably 80 or less from the viewpoint of further enhancing the washability for the soil attached to textile products by the cooperation with component (B).

The detergent composition for textile products of the present invention can contain, as component (D), other anionic surfactants than component (A) to such an extent that the effect of the present invention is not inhibited.

Examples of component (D) include one or more anionic surfactants selected from the following component (d1), component (d2), component (d3) and component (d4):

component (d1): an alkyl or alkenyl sulfate;

component (d2): a polyoxyalkylene alkyl ether sulfate or a polyoxyalkylene alkenyl ether sulfate;

component (d3): an anionic surfactant having a sulfonate group (except for component (A)); and component (d4): a fatty acid or a salt thereof.

More specific examples of component (d1) include one or more anionic surfactants selected from an alkyl sulfate in which the number of carbons of the alkyl group is 10 or more and 18 or less and an alkenyl sulfate in which the number of carbons of the alkenyl group is 10 or more and 18 or less. From the viewpoint of improvement in washability, component (d1) is preferably one or more anionic surfactants selected from an alkyl sulfate in which the number of carbons of the alkyl group is 12 or more and 14 or less, and is more preferably one or more anionic surfactants selected from a sodium alkyl sulfate in which the number of carbons of the alkyl group is 12 or more and 14 or less.

More specific examples of component (d2) include one or more anionic surfactants selected from a polyoxyalkylene alkyl sulfate in which the number of carbons of the alkyl group is 10 or more and 18 or less and an average number of moles of alkylene oxide added is 1 or more and 3 or less and a polyoxyalkylene alkenyl ether sulfate in which the number of carbons of the alkenyl group is 10 or more and 18 or less and an average number of moles of alkylene oxide added is 1 or more and 3 or less. From the viewpoint of improvement in washability, component (d2) is preferably a polyoxyethylene alkyl sulfate in which an average number of moles of ethylene oxide added is 1 or more and 2.2 or less, more preferably a polyoxyethylene alkyl sulfate in which the number of carbons of the alkyl group is 12 or more and 14 or less and an average number of moles of ethylene oxide added is 1 or more and 2.2 or less and further preferably a sodium salt thereof.

The anionic surfactant of component (d3) having a sulfonate group refers to an anionic surfactant having a sulfonate as a hydrophilic group (where component (A) is excepted).

More specific examples of component (d3) include one or more anionic surfactants selected from an alkylbenzene sulfonate in which the number of carbons of the alkyl group is 10 or more and 18 or less, an alkenylbenzene sulfonate in which the number of carbons of the alkenyl group is 10 or more and 18 or less, an alkane sulfonate in which the number of carbons of the alkyl group is 10 or more and 18 or less, an α-olefin sulfonate in which the number of carbons of the α-olefin moiety is 10 or more and 14 or less, an α-sulfofatty acid salt in which the number of carbons of the fatty acid moiety is 10 or more and 18 or less and an α-sulfofatty acid lower alkyl ester salt in which the number of carbons of the fatty acid moiety is 10 or more and 18 or less and the number of carbons of the ester moiety is 1 or more and 5 or less. From the viewpoint of improvement in washability, component (d3) is preferably an alkylbenzene sulfonate in which the number of carbons of the alkyl group is 11 or more and 14 or less, and is more preferably a sodium alkylbenzene sulfonate in which the number of carbons of the alkyl group is 11 or more and 14 or less.

Examples of the fatty acid or a salt thereof, which is component (d4), include a fatty acid with 10 or more and 20 or less carbons or a salt thereof. From the viewpoint of less inhibiting washability, the number of carbons in component (d4) is 10 or more, preferably 12 or more and more preferably 14 or more, and 20 or less and preferably 18 or less.

A salt of the anionic surfactants of component (d1) to component (d4) is preferably an alkali metal salt, more preferably a sodium salt or a potassium salt and further preferably a sodium salt.

When the detergent composition for textile products of the present invention contains component (D), the content of component (D) in the composition is preferably 0.5% by mass or more and 15% by mass or less.

The detergent composition for textile products of the present invention may be formulated with the following components (e1) to (e7) in addition to the above:

(e1) an antisoil redeposition agent and a dispersing agent such as polyacrylic acid, polymaleic acid or carboxymethyl cellulose in an amount of 0.01% by mass or more and 10% by mass or less in the composition;

(e2) a bleaching agent such as hydrogen peroxide, sodium percarbonate or sodium perborate in an amount of 0.01% by mass or more and 10% by mass or less in the composition;

(e3) a bleaching activator such as tetraacetylethylenediamine or the bleaching activators represented by the general formulas (I-2) to (I-7) in JP-A H6-316700 in an amount of 0.01% by mass or more and 10% by mass or less in the composition;

(e4) one or more enzymes selected from cellulase, amylase, pectinase, protease and lipase, preferably one or more enzymes selected from amylase and protease in an amount of 0.001% by mass or more, preferably 0.01% by mass or more, more preferably 0.1% by mass or more and further preferably 0.3% by mass or more, and 2% by mass or less and preferably 1% by mass or less in the composition;

(e5) a fluorescent dye such as a fluorescent dye commercially available as Tinopal CBS (trade name, manufactured by Ciba Specialty Chemicals Inc.) or Whitex SA (trade name, manufactured by Sumitomo Chemical Co., Ltd.) in an amount of 0.001% by mass or more and 1% by mass or less in the composition;

(e6) an antioxidant such as butylhydroxytoluene, distyrenated cresol, sodium sulfite and sodium hydrogen sulfite in an amount of 0.01% by mass or more and 2% by mass or less in the composition; and (e7) a pigment, a perfume, an antiseptic or a defoaming agent such as silicone in an appropriate amount.

The detergent composition for textile products of the present invention may be a detergent composition for textile products formulated with component (A) and component (B) as well as an optional component such as component (C).

The detergent composition for textile products of the present invention is preferably a liquid. When the detergent composition for textile products of the present invention is a liquid, the pH thereof at 20° C. is preferably 3 or more and more preferably 4 or more, and preferably 10 or less, more preferably 9 or less and further preferably 8.5 or less from the viewpoint of suppressing the deposition or separation of a solid in the composition under a low-temperature environment. The pH is measured in accordance with the method for measuring pH described below.

<Method for Measuring pH>

A composite electrode for measuring pH (manufactured by HORIBA, Ltd., glass joint sleeve type) is connected to a pH meter (manufactured by HORIBA, Ltd., pH/ion meter F-23) and the power thereof is turned on. A saturated aqueous potassium chloride solution (3.33 mol/L) is used as a pH electrode internal liquid. Next, 100 mL beakers are filled with a pH 4.01 standard solution (phthalate standard solution), a pH 6.86 standard solution (neutral phosphate standard solution) and a pH 9.18 standard solution (borate standard solution), respectively, and immersed in a thermostat bath at 25° C. for 30 minutes. The electrode for measuring pH is immersed for 3 minutes in the standard solutions adjusted at a constant temperature, and calibrated in the order of pH 6.86, pH 9.18 and pH 4.01. The above electrode of the pH meter is immersed in a sample to be measured which is adjusted at 25° C., and the pH thereof is measured after 1 minute.

The present invention provides a method for washing textile products, including washing textile products with a detergent liquid containing the detergent composition for textile products of the present invention and water. The matters mentioned in the detergent composition for textile products of the present invention can be applied to this washing method in an appropriate manner. The content of component (A) in the above detergent liquid is preferably 0.005% by mass or more, more preferably 0.01% by mass or more and further preferably 0.1% by mass or more, and preferably 1% by mass or less and more preferably 0.8% by mass or less. In addition, the content of component (B) in the above detergent liquid is preferably 0.1 mg/kg or more, more preferably 0.5 mg/kg or more, further preferably 1.0 mg/kg or more and furthermore preferably 3.0 mg/kg or more from the viewpoint of further enhancing the washability for the soil attached to fibers when washing the fibers, and preferably 800 mg/kg or less, more preferably 500 mg/kg or less, further preferably 100 mg/kg or less, furthermore preferably 50 mg/kg or less, furthermore preferably 30 mg/kg or less, furthermore preferably 10 mg/kg or less and furthermore preferably 5 mg/kg or less from the viewpoint of economical efficiency. The above detergent liquid may be detergent composition (2) for textile products of the present invention. In addition, the above detergent liquid may be prepared by diluting detergent composition (1) for textile products of the present invention.

The water with a high hardness is preferably used for the method for washing textile products of the present invention. From the viewpoint of further improving the effect of imparting texture to textile products, the water hardness is preferably 1° dH or more, more preferably 2° dH or more, further preferably 3.5° dH or more, furthermore preferably 5° dH or more and furthermore preferably 7° dH or more, and preferably 20° dH or less, more preferably 18° dH or less, and further preferably 15° dH or less in German hardness. Here, the German hardness (° dH) in the present specification refers to the concentration of calcium and magnesium in water represented by 1 mg/L (ppm)=about 0.056° dH (1° dH=17.8 ppm) in $CaCO_3$ terms.

The concentration of calcium and magnesium for this German hardness can be determined according to a chelate titration using disodium ethylenediamine tetraacetate.

A specific method for measuring the German hardness of water in the present specification is described below.

<Method for Measuring German Hardness of Water>

[Reagent]

- a 0.01 mol/l EDTA.2Na solution: a 0.01 mol/l aqueous solution of disodium ethylenediamine tetraacetate (a titration solution, 0.01 M EDTA-Na2, manufactured by Sigma-Aldrich Co. LLC.)
- a Universal BT indicator (product name: Universal BT, manufactured by Dojindo Laboratories)
- an ammonia buffer solution for measuring a hardness (a solution prepared by dissolving 67.5 g of ammonium chloride in 570 ml of a 28 w/v % aqueous ammonia and adding ion exchanged water until the entire volume reaches 1000 ml)

[Measurement of Hardness]

(1) 20 ml of sample water is collected in a conical beaker with a whole pipette.

(2) 2 ml of the ammonia buffer solution for measuring a hardness is added thereto.

(3) 0.5 ml of the Universal BT indicator is added thereto. Whether the solution after adding is colored reddish violet is checked.

(4) A 0.01 mol/l EDTA.2Na solution is dripped from a burette down to the sample water while the conical beaker is being fully shaken, and the point at which the color of the sample water turns blue is defined as the end point of the titration.

(5) The total hardness is determined by the following calculation formula:

$$\text{Hardness}(^\circ\ dH)=T\times 0.01\times F\times 56.0774\times 100/A$$

wherein,

T: Titeration amount of a 0.01 mol/l EDTA.2Na solution (mL);

A: Sample volume (20 mL, a volume of sample water); and

F: Factor of a 0.01 mol/l EDTA.2Na solution.

The detergent liquid used in the present invention is preferably a detergent liquid obtained by mixing component (A), component (B) and water with a German hardness of 1° dH or more and 20° dH or less. In addition, the above detergent liquid may be a detergent liquid obtained by mixing detergent composition (1) for textile products of the present invention and water with a German hardness of 1° dH or more and 20° dH or less.

In the method for washing textile products of the present invention, a value of the bath ratio represented by the ratio of the amount of a detergent liquid (liter) to the mass of textile products (kg), i.e., a value of the amount of a detergent liquid (liter)/the mass of textile products (kg) (hereinafter, this ratio may also be used as the bath ratio) is preferably 2 or more, more preferably 3 or more, further preferably 4 or more and furthermore preferably 5 or more, and preferably 400 or less and more preferably 300 or less.

In the method for washing textile products of the present invention, from the viewpoint of further improving the effect of imparting texture to textile products, the duration for washing textile products is preferably 1 minute or longer, more preferably 2 minutes or longer and further preferably 3 minutes or longer, and preferably 12 hours or shorter, more preferably 8 hours or shorter, further preferably 6 hours or shorter, furthermore preferably 3 hours or shorter and furthermore preferably 1 hour or shorter.

The method for washing garments of the present invention is also suitable for a rotary washing method. The rotary washing method refers to a washing method in which textile products not fixed to a rotating machine rotate along with the detergent liquid around the rotation axis. The rotary washing method can be carried out with a rotary type washing machine. Specific examples of the rotary type washing machine include a drum type washing machine, a pulsator type washing machine or an agitator type washing machine. For each of these rotary type washing machines, a household machine commercially available can be used. In terms of further reducing the amount of water used per washing, drum type washing machines which have been rapidly spread recently can especially reduce the amount of water during washing.

<Aspects of the Present Invention>

Aspects of the present invention will be illustrated below. The matters mentioned in the detergent composition for textile products and the method for washing textile products of the present invention can be appropriately applied to these aspects.

<1> A detergent composition for textile products, containing the following component (A) and the following component (B):

component (A): an internal olefin sulfonate with 16 or more and 24 or less carbons, wherein a mass ratio between an internal olefin sulfonate (IO-1S) with 16 or more and 24 or less carbons having a sulfonate group present at position 2 or higher and position 4 or lower and an internal olefin sulfonate (IO-2S) with 16 or more and 24 or less carbons having a sulfonate group present at position 5 or higher, which is (IO-2S)/(IO-1S), is 0.30 or more and 5 or less; and component (B): a soil release agent.

<2> The detergent composition for textile products according to <1>, wherein (IO-2S)/(IO-1S), which is a mass ratio of a content of (IO-2S) to a content of (IO-1S) in component (A), is 0.35 or more, preferably 0.40 or more, more preferably 0.50 or more, further preferably 0.60 or more, furthermore preferably 0.70 or more, furthermore preferably 0.80 or more, furthermore preferably 0.90 or more and furthermore preferably 1.0 or more, and 4 or less and preferably 3 or less.

<3> The detergent composition for textile products according to <1> or <2>, wherein a number of carbons in the internal olefin sulfonate of component (A) is 16 or more, and 22 or less, preferably 20 or less and more preferably 18 or less.

<4> The detergent composition for textile products according to any of <1> to <3>, wherein a content of an α-olefin sulfonate in the internal olefin sulfonate of component (A) is 10% by mass or less, preferably 7% by mass or less, more preferably 5% by mass or less and further preferably 3% by mass or less, and 0.01% by mass or more.

<5> The detergent composition for textile products according to any of <1> to <4>, wherein a proportion of component (A) in the total anionic surfactants contained in the detergent composition for textile products is 50% by mass or more and 100% by mass or less.

<6> The detergent composition for textile products according to any of <1> to <5>, wherein a proportion of component (A) in the total anionic surfactants contained in the detergent composition for textile products is 60% by mass or more, further 70% by mass or more and further 80% by mass or more, and 100% by mass or less.

<7> The detergent composition for textile products according to any of <1> to <6>, wherein component (B) is one or more soil release agents selected from: as component (b1), one or two or more of polysaccharide derivatives having one or more groups selected from a cationic group and a hydrocarbon group with 1 or more and 18 or less carbons; as component (b2), one or two or more of polymers having one or two units selected from an alkylene terephthalate unit and an alkylene isophthalate unit, and an oxyalkylene unit; and as component (b3), one or two or more of polyalkyleneimine polymers having a polyoxyalkylene group.

<8> The detergent composition for textile products according to <7>, wherein component (b1) is a polysaccharide derivative in which one or more groups selected from a cationic group and a hydrocarbon group with 1 or more and 18 or less carbons are bonded, directly or via a linking group, to a group lacking a hydrogen atom of a hydroxyl group of a polysaccharide or a derivative thereof, which is a precursor compound; and when the cationic group is bonded to the group lacking a hydrogen atom of a hydroxyl group, it is bonded thereto directly or via linking group (2), and when the hydrocarbon group is bonded to the group lacking a hydrogen atom of a hydroxyl group, it is bonded thereto directly or via linking group (1), wherein linking group (1) is one or more groups selected from: an alkyleneoxy group with 1 or more and 3 or less carbons which may have a hydroxy group; a polyoxyalkylene group in which the alkylene group is an alkylene group with 1 or more and 3 or less carbons; a carbonyl group; a carbonyloxy group; and an oxycarbonyl group; and linking group (2) is an alkylene group with 1 or more and 4 or less carbons which may include a hydroxy group.

<9> The detergent composition for textile products according to <8>, wherein the polysaccharide derivative, which is a precursor compound of component (b1), is a hydroxyalkyl-substituted product in which part of or all hydrogen atoms of hydroxyl groups of a polysaccharide is/are substituted with a hydroxyalkyl group with 1 or more and 4 or less carbons.

<10> The detergent composition for textile products according to <9>, wherein the hydroxyalkyl group with 1 or more and 4 or less carbons is a hydroxyalkyl group with 2 or more and 4 or less carbons, preferably one or more groups selected from a hydroxyethyl group, a hydroxypropyl group and a hydroxybutyl group, and more preferably one or more groups selected from a hydroxyethyl group and a hydroxypropyl group.

<11> The detergent composition for textile products according to any of <7> to <10>, wherein the polysaccharide is one or more polysaccharides selected from cellulose, guar gum or starch.

<12> The detergent composition for textile products according to any of <7> to <11>, wherein a number of carbons in the hydrocarbon group with 1 or more and 18 or less carbons is 2 or more, preferably 4 or more, more preferably 6 or more, further preferably 8 or more, furthermore preferably 10 or more and furthermore preferably 12 or more, and 16 or less and preferably 14 or less.

<13> The detergent composition for textile products according to any of <7> to <12>, wherein the hydrocarbon group is an aliphatic hydrocarbon group.

<14> The detergent composition for textile products according to any of <7> to <13>, wherein in the polysaccharide derivative of component (b1) having a hydrocarbon group with 1 or more and 18 or less carbons, a substitution degree of the hydrocarbon group with 1 or more and 18 or less carbons is 0.0001 or more, preferably 0.001 or more and more preferably 0.005 or more, and 0.4 or less, preferably 0.2 or less, more preferably 0.1 or less, further preferably 0.08 or less and furthermore preferably 0.06 or less.

<15> The detergent composition for textile products according to any of <7> to <14>, wherein the polysaccharide derivative having one or more groups selected from cationic groups is a polysaccharide derivative in which a cationic group is bonded, via the alkylene group of linking group (2) with 1 or more and 4 or less carbons which may include a hydroxy group, to a group lacking a hydrogen atom of a hydroxyl group of a polysaccharide or a derivative thereof, which is a precursor compound of component (b1), preferably the hydroxyalkyl-substituted product.

<16> The detergent composition for textile products according to any of <7> to <15>, wherein the cationic group is a group including a nitrogen cation, and preferably a quaternary ammonium group.

<17> The detergent composition for textile products according to any of <7> to <16>, wherein the cationic group is a quaternary ammonium group, and three hydrocarbon groups bonded to the quaternary ammonium group other than linking group (2) are each independently a linear hydrocarbon group with 1 or more and 4 or less carbons or a branched hydrocarbon group with 3 or more and 4 or less carbons, wherein the linear hydrocarbon group with 1 or more and 4 or less carbons is preferably a group selected from a methyl group, an ethyl group, an n-propyl group and an n-butyl group and the branched hydrocarbon group with 3 or more and 4 or less carbons is preferably a group selected from an isopropyl group, a sec-butyl group, a tert-butyl group and an isobutyl group.

<18> The detergent composition for textile products according to any of <8> to <17>, wherein in the alkylene group of linking group (2) with 1 or more and 4 or less carbons which may include a hydroxy group, the alkylene group with 1 or more and 4 or less carbons is one or more alkylene groups selected from a linear alkylene group with 1 or more and 4 or less carbons which may include a hydroxy group and a branched alkylene group with 3 or more and 4 or less carbons which may include a hydroxy group.

<19> The detergent composition for textile products according to any of <7> to <18>, wherein in the polysaccharide derivative of component (b1) having a cationic group, a substitution degree of the cationic group is 0.001 or more, preferably 0.005 or more and more preferably 0.01 or more, and 1 or less, preferably 0.7 or less, more preferably 0.4 or less, further preferably 0.35 or less, furthermore preferably 0.3 or less, furthermore preferably 0.25 or less and furthermore preferably 0.2 or less.

<20> The detergent composition for textile products according to any of <7> to <19>, wherein a weight average molecular weight of a polysaccharide or a derivative thereof, which is a precursor compound of component (b1), is 1,000 or more, preferably 10,000 or more, more preferably 30,000 or more, further preferably 50,000 or more, furthermore preferably 70,000 or more, furthermore preferably 100,000 or more, furthermore preferably 300,000 or more and furthermore preferably 500,000 or more, and 3 million or less and preferably 2.5 million or less.

<21> The detergent composition for textile products according to any of <7> to <20>, wherein the alkylene terephthalate unit is one or more selected from an ethylene terephthalate unit, a propylene terephthalate unit and a butylene terephthalate unit; the alkylene isophthalate unit is one or more selected from an ethylene isophthalate unit, a propylene isophthalate unit and a butylene isophthalate unit; and the polyoxyalkylene unit is one or more selected from a polyoxyethylene unit, a polyoxypropylene unit and a polyoxyethylene polyoxypropylene unit.

<22> The detergent composition for textile products according to any of <7> to <21>, wherein (a number of moles of the oxyalkylene unit)/(a number of moles of one or more units selected from the alkylene terephthalate unit and the alkylene isophthalate unit), a molar ratio of the oxyalkylene unit to one or more units selected from the alkylene terephthalate unit and the alkylene isophthalate unit is 0.6 or less, preferably 0.5 or less and more preferably 0.4 or less, and 0 or more and preferably 0.1 or more.

<23> The detergent composition for textile products according to any of <7> to <22>, wherein a weight average molecular weight of component (b2) is 300 or more, preferably 500 or more and more preferably 1000 or more, and 20,000 or less and preferably 15,000 or less.

<24> The detergent composition for textile products according to any of <7> to <23>, wherein component (b3) is a polyalkyleneimine polymer having a polyoxyalkylene group, wherein the oxyalkylene group of the polyoxyalkylene group is an oxyalkylene group with 2 or more and 3 or less carbons, specifically one or more groups selected from an oxyethylene group and an oxypropylene group; the alkylene group of the polyalkyleneimine is an alkylene group with 2 or more and 6 or less carbons, more specifically one or more selected from an ethylene group and a butylene group having various bonding modes; a number of the polyoxyalkylene group bonded to the polyalkyleneimine is 3 or more and 100 or less per active hydrogen of the polyalkyleneimine on average; and a weight average molecular weight of the polyalkyleneimine polymer is 300 or more, preferably 500 or more and more preferably 1000 or more, and 1 million or less, preferably 500,000 or less and more preferably 100,000 or less.

<25> The detergent composition for textile products according to any of <7> to <24>, wherein component (B) is one or two or more of polysaccharide derivatives having one or more groups selected from a hydrocarbon group with 1 or more and 18 or less carbons and a cationic group.

<26> The detergent composition for textile products according to any of <1> to <25>, wherein the detergent composition for textile products is detergent composition (1) for textile products used by diluting in water, wherein a content of component (A) in detergent composition (1) for textile products is 5% by mass or more, preferably 7% by mass or more and more preferably 10% by mass or more, and 60% by mass or less, preferably 50% by mass or less and more preferably 40% by mass or less, and a content of component (B) is 0.1% by mass or more and preferably 0.2% by mass or more, and 10% by mass or less, preferably 5% by mass or less, more preferably 3% by mass or less and further preferably 1% by mass or less.

<27> The detergent composition for textile products according to any of <1> to <25>, wherein the detergent composition for textile products is detergent composition (2) for textile products used as a detergent liquid as-is without diluting, wherein a content of component (A) in detergent composition (2) for textile products is 0.005% by mass or more, preferably 0.01% by mass or more and more preferably 0.1% by mass or more, and 1% by mass or less and preferably 0.8% by mass or less, and a content of component (B) is 0.1 mg/kg or more, preferably 0.5 mg/kg or more, more preferably 1.0 mg/kg or more and further preferably 3.0 mg/kg or more, and 800 mg/kg or less, preferably 500 mg/kg or less, more preferably 100 mg/kg or less, further preferably 50 mg/kg or less, furthermore preferably 30 mg/kg or less, furthermore preferably 10 mg/kg or less and furthermore preferably 5 mg/kg or less.

<28> The detergent composition for textile products according to any of <1> to <27>, containing water.

<29> The detergent composition for textile products according to any of <1> to <28>, further containing a nonionic surfactant as component (C).

<30> The detergent composition for textile products according to <29>, wherein component (C) is a nonionic surfactant having one or more groups selected from a hydroxyl group and a polyoxyalkylene group.

<31> The detergent composition for textile products according to <29> or <30>, wherein component (C) is a nonionic surfactant having a polyoxyalkylene group and having an HLB of 7 or more, preferably 8 or more, more preferably 9 or more and further preferably 10 or more, and 20 or less and preferably 19 or less.

<32> The detergent composition for textile products according to any of <29> to <31>, wherein component (C) is a nonionic surfactant having an HLB of 7 or more, preferably 8 or more, more preferably 9 or more and further preferably 10 or more, and 20 or less and preferably 19 or less and represented by the following general formula (C):

$$R^1(CO)_mO—(A^1O)_n—R^2 \quad (C)$$

wherein $R^1$ is an aliphatic hydrocarbon group with 9 or more and 16 or less carbons; $R^2$ is a hydrogen atom or a methyl group; CO is a carbonyl group; m is a number of 0 or 1; $A^1O$ group is one or more groups selected from an ethyleneoxy group and a propyleneoxy group; and n is an average number of added moles and is a number of 3 or more and 50 or less.

<33> The detergent composition for textile products according to <32>, wherein in general formula (C), a number of carbons of $R^1$ is 10 or more and more preferably 11 or more, and preferably 15 or less and more preferably 14 or less; the aliphatic hydrocarbon group of $R^1$ is a group selected from an alkyl group and an alkenyl group; $A^1O$ group is a group including an ethyleneoxy group; and n is 4 or more, more preferably 5 or more, and further preferably 6 or more.

<34> The detergent composition for textile products according to any of <29> to <33>, wherein a content of component (C) in the detergent composition for textile products is 1% by mass or more, preferably 3% by mass or more, more preferably 5% by mass or more and further preferably 10% by mass or more, and 60% by mass or less, preferably 50% by mass or less and further preferably 45% by mass or less.

<35> The detergent composition for textile products according to any of <29> to <34>, wherein a mass ratio (C)/(B) of a content of component (C) to a content of component (B) is 2 or more, preferably 10 or more, more preferably 20 or more and further preferably 30 or more, and 100 or less, preferably 90 or less and more preferably 80 or less.

<36> A method for washing textile products, including washing textile products with a detergent liquid containing the detergent composition for textile products according to any of <1> to <35> and water, wherein a content of component (A) in the detergent liquid is 0.005% by mass or more, preferably 0.01% by mass or more and more preferably 0.1% by mass or more, and 1% by mass or less and preferably 0.8% by mass or less, and a content of component (B) in the detergent liquid is 0.1 mg/kg or more, preferably 0.5 mg/kg or more, more preferably 1.0 mg/kg or more and further preferably 3.0 mg/kg or more, and 800 mg/kg or less, preferably 500 mg/kg or less, more preferably 100 mg/kg or less, further preferably 50 mg/kg or less, furthermore preferably 30 mg/kg or less, furthermore preferably 10 mg/kg or less and furthermore preferably 5 mg/kg or less.

EXAMPLES

<Formulation Components>

[Component (A) or Component (A')]

Component (A) or component (A') is an internal olefin sulfonate. In Table 1, the bonding distribution of sulfonate groups of the internal olefin sulfonates used in Examples, Comparative Examples, Formulation Examples and Comparative Formulation Examples is shown. While component (A') is also component (D), it is denoted as component (A') for convenience as it is a comparative compound of component (A).

Component (A) or component (A') listed in Table 1 was obtained by sulfonating internal olefins having different double-bond positions. Sodium hydroxide was used for the neutralization after the sulfonation. Content proportions of the internal olefin sulfonates in which a sulfonate group is bonded were measured by a high performance liquid chromatography/mass spectrometer (HPLC-MS). Specifically, the hydroxy forms in which a sulfonate group is bonded were separated by high performance liquid chromatography (HPLC) and each of them were subjected to a mass spectrometer (MS) to be identified. Each proportion was determined from the resulting HPLC-MS peak area. In the present specification, each proportion determined from the peak area was calculated as a proportion by mass.

Note that the devices and conditions used for the measurement are as follows: an HPLC device "LD20ASXR" (manufactured by Shimadzu Corporation); a column "ODS Hypersil (R)" (4.6×250 mm, particle size: 3 μm, manufactured by Thermo Fisher Scientific K.K.); sample preparation (1000 times diluted with methanol); eluent A (10 mM ammonium acetate-added water); eluent B (10 mM ammonium acetate-added methacrylonitrile/water=95/5 (v/v) solution); gradient (0 minute (A/B=60/40)→15.1 to 20 minutes (30/70)→20.1 to 30 minutes (60/40); an MS device "LCMS-2020" (manufactured by Shimadzu Corporation); ESI detection (negative ion detection, m/z: 321.10 (component (A) having 16 carbons); column temperature (40° C.); flow rate (0.5 mL/min); and injection volume (5 μL).

[Component (B)]

Synthesis of (b-1)

90 g of hydroxyethyl cellulose (Ashland, Natrosol 250 GR, weight average molecular weight: 300,000, substitution degree of hydroxyethyl group (MS): 2.5) was fed into a 1 L separable flask and nitrogen was flowed thereinto. 77.2 g of ion exchanged water and 414.5 g of isopropyl alcohol (hereinafter, referred to as IPA) were added thereto and stirred for 5 minutes and after that, 10.9 g of a 48% aqueous sodium hydroxide solution was added thereto and further stirred for 15 minutes. Next, 5.6 g of lauryl glycidyl ether (Yokkaichi Chemical Co., Ltd., LA-EP) was added thereto and alkylated at 80° C. for 13 hours. Furthermore, 12.9 g of glycidyltrimethylammonium chloride (Sakamoto Yakuhin Kogyo Co., Ltd., SY-GTA80) was added thereto and cationized at 50° C. for 1.5 hours. Thereafter, 10.9 g of a 90% aqueous acetic acid solution was added thereto and stirred for 30 minutes, thereby carrying out the neutralization reaction.

The obtained suspension was transferred equally to two 500 mL centrifuge tubes and subjected to centrifugation using a high speed refrigerated centrifuge (Hitachi Koki Co., Ltd., CR21G III). The supernatant was removed by decantation, and an 85% IPA aqueous solution in the same amount as that of the removed supernatant was added thereto and redispersed. The centrifugation and redispersion operations were repeated again, and after carrying out the third centrifugation, the precipitate was taken out. The obtained precipitate was dried under reduced pressure using a vacuum dryer (ADVANTEC CO., LTD., VR-420) at 80° c. overnight and crushed by an extreme mill (WARING COMMERCIAL, MX-1200XTM) to obtain (b-1) as a powdery cellulose derivative composition. In the obtained (b-1), the substitution degree of the lauryl group was 0.030 and the substitution degree of the cationic group was 0.023.

Synthesis of (b-2) and (b-3)

For obtaining the following (b-2) and (b-3), in the above synthesis of (b-1), the weight average molecular weight of the hydroxyethyl cellulose of a raw material (the substitution degree of the hydroxyethyl group remains the same), the amount of the lauryl glycidyl ether fed, the glycidyltrimethylammonium chloride, the reaction conditions and the like were appropriately changed.

(b-2)

The weight average molecular weight of the hydroxyethyl cellulose of a raw material of component (b-2) was 150,000, the substitution degree of the lauryl group was 0.019 and the substitution degree of the cationic group was 0.10.

(b-3)

The weight average molecular weight of the hydroxyethyl cellulose of a raw material of component (b-3) was 2.1 million, the substitution degree of the lauryl group was 0.016 and the substitution degree of the cationic group was 0.092.

Synthesis of (b-4)

90 g of hydroxyethyl cellulose (Dow Inc., QP-100MH, weight average molecular weight: 2.1 million, substitution degree of hydroxyethyl group (MS): 2.5) was fed into a 1 L separable flask and nitrogen was flowed thereinto. 77.2 g of ion exchanged water and 414.5 g of isopropyl alcohol (hereinafter, referred to as IPA) were added thereto and stirred for 5 minutes and after that, 10.9 g of a 48% aqueous sodium hydroxide solution was added thereto and further stirred for 15 minutes. Next, 10.1 g of 1,2-epoxyoctane (Wako Pure Chemical Industries, Ltd.) was added thereto and alkylated at 80° C. for 13 hours. Thereafter, 10.9 g of a 90% aqueous acetic acid solution was added thereto and stirred for 30 minutes, thereby carrying out the neutralization reaction.

The obtained suspension was transferred equally to two 500 mL centrifuge tubes and subjected to centrifugation using a high speed refrigerated centrifuge (Hitachi Koki Co., Ltd., CR21G III). The supernatant was removed by decantation, and an 85% IPA aqueous solution in the same amount as that of the removed supernatant was added thereto and redispersed. The centrifugation and redispersion operations were repeated again and after carrying out the third centrifugation, the precipitate was taken out. The obtained precipitate was dried under reduced pressure using a vacuum dryer (ADVANTEC CO., LTD., VR-420) at 80° c. overnight and crushed by an extreme mill (WARING COMMERCIAL, MX-1200XTM) to obtain (b-4) as a powdery cellulose derivative composition. In the obtained (b-4), the substitution degree of the hexyl group was 0.053.

Synthesis of (b-5) to (b-9)

For obtaining the following (b-5) to (b-7), in the above synthesis of (b-4), the weight average molecular weight of the hydroxyethyl cellulose of a raw material was appropriately changed; different 1,2-epoxyalkanes with different lengths of hydrocarbon groups (the number of carbons of the hydrocarbon group corresponded to that of the hydrocarbon group of each compound) were used instead of the 1,2-epoxyoctane; and the fed amounts, reaction conditions and the like were appropriately changed. In addition, stearyl glycidyl ether was used instead of the 1,2-epoxyoctane, and the fed amounts, reaction conditions and the like were appropriately changed in the above synthesis of (b-4) to obtain the following (b-8). Furthermore, lauryl glycidyl ether was used instead of the 1,2-epoxyoctane, and the fed amounts, reaction conditions and the like were appropriately changed in the above synthesis of (b-4) to obtain the following (b-9).

(b-5)

The weight average molecular weight of hydroxyethyl cellulose (substitution degree of hydroxyethyl group: 2.5) of a raw material of (b-5) was 2.1 million and the substitution degree of the decyl group was 0.013.

(b-6)

The weight average molecular weight of hydroxyethyl cellulose (substitution degree of hydroxyethyl group: 2.5) of a raw material of (b-6) was 2.1 million and the substitution degree of the lauryl group was 0.015.

(b-7)

The weight average molecular weight of hydroxyethyl cellulose (substitution degree of hydroxyethyl group: 2.5) of a raw material of (b-7) was 2.1 million and the substitution degree of the palmityl group was 0.0059.

(b-8)

The weight average molecular weight of hydroxyethyl cellulose (substitution degree of hydroxyethyl group: 2.5) of a raw material of (b-8) was 2.1 million and the substitution degree of the stearyl group was 0.010.

(b-9)

The weight average molecular weight of hydroxyethyl cellulose (substitution degree of hydroxyethyl group: 2.5) of a raw material of (b-9) was 300,000 and the substitution degree of the lauryl group was 0.0096.

Synthesis of (b-10)

The same operations as in the synthesis of (b-1) were carried out to obtain the following (b-10) except that the amount of the glycidyltrimethylammonium chloride was changed to 18.2 g and the reaction with lauryl glycidyl ether was not carried out.

(b-10)

The weight average molecular weight of hydroxyethyl cellulose (substitution degree of hydroxyethyl group: 2.5) of a raw material of (b-10) was 300,000 and the substitution degree of the cationic group was 0.14.

Synthesis of (b-11) and (b-12)

The same operations as in the synthesis of (b-1) were carried out to obtain the following (b-11) and (b-12) except that the amount of the glycidyltrimethylammonium chloride was appropriately changed and the reaction with lauryl glycidyl ether was not carried out.

(b-11)

The weight average molecular weight of hydroxyethyl cellulose (substitution degree of hydroxyethyl group: 2.5) of a raw material of (b-11) was 300,000 and the substitution degree of the cationic group was 0.04.

(b-12)

Polyoxyethylene Terephthalate (Repel-O-Tex-SRP4 manufactured by Rhodia)

The substitution degree of component (B) and the weight average molecular weight of a precursor compound of component (B) were measured in the following manner.

(1) Measurement of Substitution Degree

Pretreatment of Polysaccharide Derivative

After dissolving 1 g of a polysaccharide derivative of component (B) in 100 g of water, the aqueous solution was put into a dialysis membrane (Spectra/Por, cutoff molecular weight: 1000) and subjected to a dialysis for 2 days. The obtained aqueous solution was freeze-dried using a freeze-drier (eyela, FDU-1100) to obtain a pretreated polysaccharide derivative.

Calculation of Mass of Cationic Group According to Kjeldahl Method 200 mg of the polysaccharide derivative pretreated in the above manner was precisely weighed, and 10 mL of concentrated sulfuric acid and one Kjeldahl tablet (Merck) were added thereto and subjected to a thermal decomposition in a Kjeldahl decomposition device (manufactured by BUCHI Labortechnik AG, K-432). After the decomposition ended, 30 mL of ion exchanged water was added to the sample and a content of nitrogen (% by mass) in the sample was determined using an automatic Kjeldahl distillation device (manufactured by BUCHI Labortechnik AG, K-370), thereby calculating a mass of the cationic group.

Calculation of Mass of Hydrocarbon Group (Alkyl Group) According to Zeisel Method 200 mg of the polysaccharide derivative pretreated in the above manner and 220 mg of adipic acid were precisely weighed in a 10 mL vial (mighty vial No. 3) and 3 mL of an internal standard solution (tetradecane/o-xylene=1/25 (v/v)) and 3 mL of hydriodic acid were added thereto, and the vial was tightly sealed. In addition, a sample for the calibration curve was prepared by adding 2.4 mg or 9 mg of 1-iododecane instead of the polysaccharide derivative. Each sample was heated while stirred with a stirrer tip, using a block heater (manufactured by PIERCE, Reacti-Therm III Heating/Stirring module) under conditions of 160° C. and 2 hours. After cooling the sample to room temperature, the upper layer (o-xylene layer) was collected and analyzed by gas chromatography (GC) (Shimadzu Corporation, QD2010 plus) under the following conditions:

GC Analysis Conditions

Column: Agilent HP-1 (length: 30 m, liquid phase film thickness: 0.25 μL, inner diameter: 32 mm)

Split ratio: 20

Column temperature: 100° C. (2 min)→10° C./min→300° C. (15 min)

Injector temperature: 300° C.

Detector: HID

Detector temperature: 330° C.

Introduction amount: 2 μL.

From the amount of the detected 1-iododecane obtained by GC, a mass of the alkyl group in the sample was determined.

Measurement of Mass of Hydroxyalkyl Group

A mass of a hydroxyalkyl group was measured by quantifying an alkyl iodide derived from the hydroxyalkyl group in the same manner as the above measurement of the mass of the alkyl group.

Calculation of Substitution Degrees of Cationic Group and Alkyl Group

The substitution degrees of the cationic group and the alkyl group were calculated in the molar average by calculating the mass of the skeleton of the polysaccharide derivative from the above masses of the cationic group and the alkyl group and the total mass of the sample and converting each of them into the amount of substance (mol).

Measurement of Weight Average Molecular Weight

The weight average molecular weight of hydroxyethyl cellulose (HEC) which is a precursor compound of component (B) was calculated in terms of polyethylene glycol by GPC (gel permeation chromatography).

The measurement conditions are as follows:

Column: TSKgel α-M

Eluent: 50 mmol/L LiBr, 1% $CH_3COOH$, ethanol/water=3/7

Temperature: 40° C.

Flow rate: 0.6 mL/min.

[Component (C)]

(c-1): a polyoxyalkylene lauryl ether (a compound obtained by adding 9 moles on average of an ethyleneoxy group to 1 mole of lauryl alcohol, then adding 2 moles on average of a propyleneoxy group thereto and then adding 9 moles on average of an ethyleneoxy group thereto; HLB=14.5)

(c-2): a polyoxyethylene lauryl ether (a compound obtained by adding 14 moles on average of an ethyleneoxy group to 1 mole of lauryl alcohol; HLB=15.4)

(c-3): a polyoxyethylene alkyl ether (the alkyl group is a mixed alkyl group of lauryl group/myristyl group=8/2 (mass ratio); the average number of moles of the oxyethylene group added is 10 moles; and HLB=13.9)

[Component (D)]

(d-1): a sodium α-olefin sulfonate having 12 to 14 carbons

[Water]

Ion exchanged water

<Preparation of Detergent Composition (1) for Textile Products>

Using the above formulation components, detergent compositions (1) for textile products shown in Table 2 and Table 3 were prepared, and detergent compositions (1) for textile products shown in Table 2 were evaluated as to the following items. The results are shown in Table 2.

Detergent compositions (1) for textile products shown in Table 2 and Table 3 were specifically prepared as follows. A stirrer piece made of Teflon (R) 5 cm in length was put into a glass beaker 200 mL in volume and the mass thereof was measured. Next, 80 g of ion exchanged water at 20° C., component (A) or component (A'), component (B), optional component (C) and the like were put thereinto and the beaker was sealed at the top side thereof with Saran Wrap (R).

The beaker with the contents was put into a water bath at 60° C. placed on a magnetic stirrer, and stirred at 100 r/min for 30 minutes while the water temperature in the water bath was kept within a temperature range of 60±2° C. Next, the water in the water bath was replaced with tap water at 5° C., and the composition in the beaker was cooled down until the temperature thereof reached 20° C. Next, Saran Wrap (R) was removed, and ion exchanged water was added thereto until the mass of the contents reached 100 g and stirred again at 100 r/min for 30 seconds to obtain detergent compositions (1) for textile products listed in Table 2 and Table 3.

<Preparation of Detergent Composition (2) for Textile Products>

Using the above formulation components, detergent compositions (2) for textile products shown in Table 4 were prepared.

Detergent compositions (2) for textile products shown in Table 4 were specifically prepared as follows. A stirrer piece made of Teflon (R) 8 cm in length was put into a glass beaker 1000 mL in volume and the mass thereof was measured. Next, 800 g of water which was prepared to have the hardness of 4° dH by adding calcium chloride and magnesium chloride at a proportion of 8:2 by a mass ratio to ion exchanged water at 20° C., component (A) or component (A'), component (B), optional component (C) and the like were put thereinto in the formulation of Table 4, and the beaker was sealed at the top side thereof with Saran Wrap (R).

The beaker with the contents was put into a water bath at 60° C. placed on a magnetic stirrer, and stirred at 200 r/min for 30 minutes while the water temperature in the water bath was kept within a temperature range of 60±2° C. Next, the water in the water bath was replaced with tap water at 5° C., and the composition in the beaker was cooled down until the temperature thereof reached 20° C. Next, Saran Wrap (R) was removed, and water which was prepared to have the hardness of 4° dH by adding calcium chloride and magnesium chloride at a proportion of 8:2 by a mass ratio to ion exchanged water at 20° C. was added until the mass of the contents reached 100 g and stirred again at 200 r/min for 30 seconds to obtain detergent compositions (2) for textile products listed in Table 4.

In Table 4, for example, 150 mg/kg, a concentration of component (A), corresponds to 0.015% by mass.

In addition, in Table 4, the balance of detergent composition (2) for textile products is water with the hardness of 4° dH in an amount with which the total composition adds up to 1 kg.

<Evaluation of Washability>

Using detergent composition (1) for textile products shown in Table 2, evaluation of washability was carried out. The results are shown in Table 2. In addition, washability of detergent composition (1) for textile products shown in Table 3 can also be evaluated in the following manner. Furthermore, washability of detergent composition (2) for textile products shown in Table 4 can be evaluated by replacing the following detergent liquid with detergent composition (2) for textile products shown in Table 4.

(1) Pretreatment of Textile Products Including Chemical Fibers

18 AIRism crew neck short-sleeve t-shirts (fiber constitution: polyester 89%, polyurethane 11%; manufactured by FAST RETAILING CO., LTD.; product number 182496; and size 4XL) were washed with a standard course of a fully automatic washing machine (manufactured by Panasonic Corporation, NA-F70PB1) five times in a cumulative manner (4.8 g of EMULGEN 108 (manufactured by Kao Corporation) for washing; amount of water: 48 L; washed for 12 minutes; rinsed twice; and dewatered for 3 minutes). Thereafter, they were washed once with water alone (amount of water: 48 L; washed for 12 minutes; rinsed twice; and dewatered for 3 minutes), further rinsed with running water using a two tank type washing machine (manufactured by Hitachi, Ltd., model: PS-H45L) until bubbles completely disappeared, and dried at 24° C. for 24 hours at 55% RH. Thereafter, they were cut into 6 cm×6 cm sized pieces.

(2) Preparation of Textile Products for Evaluating Washability (2-1) Preparation of Soil Release-Treated Clothes Soil release treatment was carried out using a shaker (Yamato Scientific Co., Ltd., model number: SA300). The water used for the treatment was washing water which was prepared to have the hardness of 4° dH by adding calcium chloride and magnesium chloride at a proportion of 8:2 by a mass ratio to ion exchanged water. A detergent liquid was obtained by mixing component (A), component (B) and component (C) with the washing water such that the total amounts of the components in detergent composition (1) for textile products listed in Table 2 is at a concentration of 150 mg/kg in the detergent liquid. 50 mL of the detergent liquid (24° C.) and 5 pieces of the textile products obtained in the above (1) were put into a 100 mL screw bottle (Maruemu Corporation, No. 8, 40 mm×120 mm). The bath ratio was 20. The textile products were shaken in a horizontally reciprocating manner with a shaker at 300 rpm for 10 minutes. After the treatment, they were dewatered for 1 minute with a two tank type washing machine (manufactured by Hitachi, Ltd., model: PS-H45L). Next, 50 mL of the washing water (24° C.) and the obtained textile products were put into a 100 mL screw bottle. The textile products were rinsed with a shaker at 340 rpm for 3 minutes. After rinsing, they were dewatered for 1 minute with the two tank type washing machine and dried at 24° C. for 24 hours at 55% RH to prepare textile products for evaluating washability.

(2-2) Preparation of Soil Release-Treated Clothes Artificially Soiled with Model Sebum 0.1 mL of model sebum solution for artificially soiling formed by mixing 0.02% Sudan III (manufactured by Tokyo Chemical Industry Co., Ltd.) as a pigment into a model sebum with the following composition was applied to the center of each textile product obtained in the above (2-1) in the shape of a circle 4 cm in diameter and the textile products were dried for 1 hour with an air-blow constant-temperature drying oven (manufactured by ADVANTEC CO., LTD., DRM420DA) under an environment of 60° C. Thereafter, the textile products were dried under an environment of 20° C. and 70% RH for 24 hours to prepare soil release-treated clothes artificially soiled with the model sebum. *Composition of the model sebum: lauric acid: 0.54% by mass, myristic acid: 1.78% by mass, pentadecanoic acid: 0.91% by mass, palmitic acid: 3.53% by mass, heptadecanoic acid: 0.30% by mass, linoleic acid: 1.40% by mass, oleic acid: 19.74% by mass, triolein: 46.00% by mass, squalene: 13.80% by mass, cholesterol: 2.90% by mass, sterol ester: 3.00% by mass, and n-hexadecyl palmitate: 6.10% by mass (total: 100% by mass).

(2-3) Washing Test

Washing operation was carried out using a tergotometer (manufactured by Ueshima Seisakusho Co., Ltd., MS-8212). The water used for the washing was washing water which was prepared to have the hardness of 4° dH by adding calcium chloride and magnesium chloride at a proportion of 8:2 by a mass ratio to ion exchanged water. A detergent liquid was obtained by mixing component (A), component (B) and component (C) with the washing water such that the total amounts of the components in detergent composition (1) for textile products listed in Table 2 is at a concentration of 150 mg/kg in the detergent liquid. 600 mL of the detergent liquid and five pieces of the clothes artificially soiled with the model sebum obtained in the above (2-2) were put into a 1L stainless steel beaker for washing test (bath ratio: 300). The temperature of the detergent liquid was 20° C. The clothes artificially soiled with the model sebum were washed with the tergotometer at 85 rpm for 10 minutes. After washing, they were rinsed in 5 L of reserved water. After rinsing, they were dewatered and dried at 24° C. for 24 hours at 55% RH.

(2-4) Evaluation of Washing Rate

Washing rates obtained in the washing test of the above (2-3) for the clothes artificially soiled with the model sebum were measured in the following manner and the average value of 5 pieces was determined. The results are shown in Table 2. The reflectances at 460 nm for the original clothes before soiling and the clothes before and after washing were measured with a differential colorimeter (manufactured by Nippon Denshoku Industries Co., Ltd., SE-2000) and the washing rates (%) were determined according to the following formula. Calibration was carried out using a standard reflector (white, X: 94.03, Y: 95.96, Z: 113.16). Note that the values in Table 2 are the average values of the washing rates for 5 pieces. The larger the value of washing rate is, the more excellent the washability is.

$$\text{Washing rate (\%)}=100\times[(\text{reflectance after washing}-\text{reflectance before washing})/(\text{reflectance of original cloth}-\text{reflectance before washing})]$$

TABLE 1

| | | | Component (A) | | | | | |
|---|---|---|---|---|---|---|---|---|
| | | | (a-1) | (a-2) | (a-3) | (a-4) | (a-5) | (a-6) |
| Number of carbons in raw material olefin | | | 16 | 16 | 16 | 16 | 16 | 16 |
| Distribution of sulfonate groups (% by mass) | Position 1 (IO-1S) | | 1.2 | 1.5 | 1.4 | 1.2 | 1.1 | 0.9 |
| | | Position 2 | 27.2 | 24.1 | 22.3 | 20.4 | 18.6 | 16.8 |
| | | Position 3 | 21.6 | 19.9 | 18.4 | 17.1 | 15.6 | 14.3 |
| | | Position 4 | 25.0 | 24.6 | 23.5 | 22.4 | 21.3 | 20.2 |
| | (IO-2S) | Position 5 or higher | 25.0 | 29.9 | 34.4 | 38.9 | 43.4 | 47.8 |
| | | Total | 100.0 | 100.0 | 100.0 | 100.0 | 100.0 | 100.0 |
| | (IO-1S) (% by mass) | | 73.8 | 68.6 | 64.2 | 59.9 | 55.5 | 51.3 |
| (IO-2S)/(IO-1S) (mass ratio) | | | 0.34 | 0.44 | 0.54 | 0.65 | 0.78 | 0.93 |

| | | | Component (A) | | | Component (A') |
|---|---|---|---|---|---|---|
| | | | (a-7) | (a-8) | (a-9) | (a'-1) |
| Number of carbons in raw material olefin | | | 16 | 16 | 18 | 16 |
| Distribution of sulfonate groups (% by mass) | Position 1 (IO-1S) | | 0.8 | 0.6 | 1.4 | 0.9 |
| | | Position 2 | 14.9 | 13.1 | 22.1 | 30.2 |
| | | Position 3 | 12.9 | 11.5 | 17.2 | 23.1 |
| | | Position 4 | 19.1 | 18.0 | 21.8 | 25.5 |
| | (IO-2S) | Position 5 or higher | 52.3 | 56.8 | 37.5 | 20.3 |
| | | Total | 100.0 | 100.0 | 100.0 | 100.0 |
| | (IO-1S) (% by mass) | | 46.9 | 42.6 | 61.1 | 78.8 |
| (IO-2S)/(IO-1S) (mass ratio) | | | 1.1 | 1.3 | 0.61 | 0.26 |

TABLE 2

| | | | | Examples | | | | | | | | | | | | | | | | |
|---|---|---|---|---|---|---|---|---|---|---|---|---|---|---|---|---|---|---|---|---|
| | | | | 1 | 2 | 3 | 4 | 5 | 6 | 7 | 8 | 9 | 10 | 11 | 12 | 13 | 14 | 15 | 16 | 17 |
| Detergent composition (1) for textile products | Formulation component (% by mass) | (A) | (a-1) | 23 | | | | | | | | | | | | | | | | |
| | | | (a-2) | | 23 | | | | | | | | | | 23 | | | | | |
| | | | (a-3) | | | 23 | | | | | | | | | | 23 | | | | |
| | | | (a-4) | | | | 23 | | | | | | | | | | 23 | | | |
| | | | (a-5) | | | | | 23 | | | | 23 | 23 | 23 | | | | 23 | | |
| | | | (a-6) | | | | | | 23 | | | | | | | | | | 23 | |
| | | | (a-7) | | | | | | | 23 | | | | | | | | | | 23 |
| | | | (a-8) | | | | | | | | 23 | | | | | | | | | |
| | | | (a-9) | | | | | | | | | | | | | | | | | |
| | | (A') | (a'-1) | | | | | | | | | | | | | | | | | |
| | | (B) | (b-1) | 0.3 | 0.3 | 0.3 | 0.3 | 0.3 | 0.3 | 0.3 | 0.3 | | | 0.3 | | | | | | |
| | | | (b-2) | | | | | | | | | 0.3 | | | | | | | | |
| | | | (b-3) | | | | | | | | | | 0.3 | | | | | | | |
| | | | (b-4) | | | | | | | | | | | | 0.3 | 0.3 | 0.3 | 0.3 | 0.3 | 0.3 |
| | | | (b-5) | | | | | | | | | | | | | | | | | |
| | | | (b-6) | | | | | | | | | | | | | | | | | |
| | | | (b-7) | | | | | | | | | | | | | | | | | |
| | | | (b-8) | | | | | | | | | | | | | | | | | |
| | | | (b-9) | | | | | | | | | | | | | | | | | |
| | | | (b-10) | | | | | | | | | | | | | | | | | |
| | | | (b-11) | | | | | | | | | | | | | | | | | |
| | | (C) | (c-1) | 23 | 23 | 23 | 23 | 23 | 23 | 23 | 23 | 23 | 23 | | 23 | 23 | 23 | 23 | 23 | 23 |
| | | | (c-2) | | | | | | | | | | | 23 | | | | | | |
| | | | (c-3) | | | | | | | | | | | | | | | | | |
| | | (D) | (d-1) | | | | | | | | | | | | | | | | | |
| | | Ion exchanged water | | Balance | Balance | Balance | Balance | Balance | Balance | Balance | Balance | Balance | Balance | Balance | Balance | Balance | Balance | Balance | Balance | Balance |
| | Total | | | 100 | 100 | 100 | 100 | 100 | 100 | 100 | 100 | 100 | 100 | 100 | 100 | 100 | 100 | 100 | 100 | 100 |
| Washing rate (%) | | | | 33 | 35 | 36 | 41 | 43 | 48 | 48 | 48 | 40 | 45 | 35 | 35 | 37 | 43 | 43 | 44 | 47 |

| | | | | Examples | | | | | | | | | | | Comparative Examples | | |
|---|---|---|---|---|---|---|---|---|---|---|---|---|---|---|---|---|---|
| | | | | 18 | 19 | 20 | 21 | 22 | 23 | 24 | 25 | 26 | 27 | 28 | 1 | 2 | 3 |
| Detergent composition (1) for textile products | Formulation component (% by mass) | (A) | (a-1) | | | | | | | | | | | | | | |
| | | | (a-2) | | | | | | | | | | | | | | |
| | | | (a-3) | | | | | | | | | | | | | | |
| | | | (a-4) | | | | | | | | | | | | | | |
| | | | (a-5) | | 23 | 23 | 23 | 23 | 23 | | | 23 | 23 | 23 | | | |
| | | | (a-6) | | | | | | | | | | | | | | |
| | | | (a-7) | | | | | | | | | | | | | 23 | |
| | | | (a-8) | 23 | | | | | | | | | | | | | |
| | | | (a-9) | | | | | | | 23 | 23 | | | | | | |
| | | (A') | (a'-1) | | | | | | | | | | | | 23 | | |

TABLE 2-continued

| | | | | | | | | | | | | | | | | |
|---|---|---|---|---|---|---|---|---|---|---|---|---|---|---|---|---|
| | (B) | (b-1) | | | | | | | | | 0.3 | | | 0.3 | | 0.3 |
| | | (b-2) | | | | | | | | | | | | | | |
| | | (b-3) | | | | | | | | | | | | | | |
| | | (b-4) | 0.3 | | | | | | | | | | | | | |
| | | (b-5) | | 0.3 | | | | | | | | | | | | |
| | | (b-6) | | | 0.3 | | | | 0.3 | | | | | | | |
| | | (b-7) | | | | 0.3 | | | | 0.3 | | | | | | |
| | | (b-8) | | | | | 0.3 | | | | | | | | | |
| | | (b-9) | | | | | | 0.3 | | | | | | | | |
| | | (b-10) | | | | | | | | | | 0.3 | | | | |
| | | (b-11) | | | | | | | | | | | 0.3 | | | |
| | (C) | (c-1) | 23 | 23 | 23 | 23 | 23 | 23 | 23 | 23 | | 23 | 23 | 23 | 23 | 23 |
| | | (c-2) | | | | | | | | | | | | | | |
| | | (c-3) | | | | | | | | | 23 | | | | | |
| | (D) | (d-1) | | | | | | | | | | | | | | 23 |
| | Ion exchanged water | | Balance | Balance | Balance | Balance | Balance | Balance | Balance | Balance | Balance | Balance | Balance | Balance | Balance | Balance |
| | Total | | 100 | 100 | 100 | 100 | 100 | 100 | 100 | 100 | 100 | 100 | 100 | 100 | 100 | 100 |
| Washing rate (%) | | | 47 | 43 | 44 | 36 | 35 | 40 | 33 | 35 | 43 | 37 | 35 | 31 | 31 | 30 |

TABLE 3

| | | | | Formulation Example (1) | | | | | | | | | |
|---|---|---|---|---|---|---|---|---|---|---|---|---|---|
| | | | | 1 | 2 | 3 | 4 | 5 | 6 | 7 | 8 | 9 | 10 |
| Detergent composition (1) for textile products | Formulation component (% by mass) | (A) | (a-1) | 10 | | | | | | | | | |
| | | | (a-3) | | 10 | | | | | | | | |
| | | | (a-5) | | | 10 | | | 10 | 35 | 40 | | |
| | | | (a-7) | | | | 10 | | | | | 25 | 25 |
| | | | (a-9) | | | | | 10 | | | | | |
| | | (A') | (a'-1) | | | | | | | | | | |
| | | (B) | (b-1) | 0.15 | 0.15 | 0.15 | 0.15 | 1 | | 0.5 | 0.5 | | |
| | | | (b-4) | | | | | | 0.15 | | | | |
| | | | (b-10) | | | | | | | | | 0.5 | |
| | | | (b-11) | | | | | | | | | | 0.5 |
| | | | (b-12) | | | | | | | | | | |
| | | (C) | (c-1) | 5 | 5 | 5 | 5 | 5 | 5 | 10 | | 15 | 15 |
| | | | (c-2) | | | | | | | | 15 | | |
| | | | (c-3) | | | | | | | | | | |
| | | (D) | (d-1) | | | | | | | | | | |
| | | Ion exchanged water | | Balance | Balance | Balance | Balance | Balance | Balance | Balance | Balance | Balance | Balance |
| | | Total | | 100 | 100 | 100 | 100 | 100 | 100 | 100 | 100 | 100 | 100 |

| | | | | Formulation Example (1) | | | | | Comparative Formulaton Example (1) | | |
|---|---|---|---|---|---|---|---|---|---|---|---|
| | | | | 11 | 12 | 13 | 14 | 15 | 1 | 2 | 3 |
| | Detergent composition (1) for textile products | Formulation component (% by mass) | (A) (a-1) | | | | | | | | |
| | | | (a-3) | | | | | | | | |
| | | | (a-5) | | | 23 | 23 | 23 | | | |
| | | | (a-7) | | | | | | | 10 | |
| | | | (a-9) | 15 | 23 | | | | | | |
| | | | (A') (a'-1) | | | | | | 10 | | |
| | | | (B) (b-1) | | | 0.3 | | | 0.15 | | 0.15 |
| | | | (b-4) | | | | | | | | |
| | | | (b-10) | | | | 0.3 | | | | |
| | | | (b-11) | | | | | | | | |
| | | | (b-12) | 30 | | | | 0.3 | | | |
| | | | (C) (c-1) | | 23 | | 23 | 23 | 5 | 5 | 5 |
| | | | (c-2) | | | | | | | | |
| | | | (c-3) | 10 | | 23 | | | | | |
| | | | (D) (d-1) | | | | | | | | 10 |
| | | | Ion exchanged water | Balance | Balance | Balance | Balance | Balance | Balance | Balance | Balance |
| | | | Total | 100 | 100 | 100 | 100 | 100 | 100 | 100 | 100 |

TABLE 4

| | | | | Formulation Example (2) | | | | | | | | | | | | | | | Comparative Formulation Example (2) | | |
|---|---|---|---|---|---|---|---|---|---|---|---|---|---|---|---|---|---|---|---|---|---|
| | | | | 1 | 2 | 3 | 4 | 5 | 6 | 7 | 8 | 9 | 10 | 11 | 12 | 13 | 14 | 15 | 1 | 2 | 3 |
| Detergent composition (2) for textile products | Formulation component (mg/kg) | (A) | (a-1) | 150 | | | | | | | | | | | | | | | | | |
| | | | (a-2) | | 150 | | | | | | | | | | | | | | | | |
| | | | (a-4) | | | 150 | | | 300 | 300 | 150 | | | | | 120 | 120 | 120 | | | |
| | | | (a-6) | | | | 150 | | | | | 100 | 200 | | | | | | | 150 | |
| | | | (a-8) | | | | | 150 | | | | | | 300 | 200 | | | | | | |
| | | (A') | (a'-1) | | | | | | | | | | | | | | | | 150 | | |
| | | (B) | (b-1) | 5 | 5 | 5 | 5 | 3 | | 2 | 2 | | | | | 4 | | | 5 | | 5 |
| | | | (b-5 | | | | | | 4.5 | | | | | | | | | | | | |
| | | | (b-10) | | | | | | | | | 10 | | | | | 4 | | | | |
| | | | (b-11) | | | | | | | | | | 2 | | | | | | | | |
| | | | (b-12) | | | | | | | | | | | 300 | | | | 4 | | | |
| | | (C) | (c-1) | 150 | 150 | 150 | 150 | 150 | 150 | 300 | | 200 | 200 | | 23 | | 23 | 23 | 150 | 150 | 5 |
| | | | (c-2) | | | | | | | | 150 | | | | | | | | | | |
| | | | (c-3) | | | | | | | | | | | 120 | | 120 | | | | | |
| | | (D) | (d-1) | | | | | | | | | | | | | | | | | | 150 |

The invention claimed is:

1. A detergent composition for textile products, comprising the following component (A) and the following component (B):

component (A): an internal olefin sulfonate with 16 or more and 24 or less carbons, wherein a mass ratio between an internal olefin sulfonate (IO-1S) with 16 or more and 24 or less carbons having a sulfonate group present at position 2 or higher and position 4 or lower and an internal olefin sulfonate (IO-2S) with 16 or more and 24 or less carbons having a sulfonate group present at position 5 or higher, which is (IO-2S)/(IO-1S), is 0.30 or more and 5 or less; and component (B): one or more soil release agents selected from the following components (b1), (b2) and (b3):

component (b1): one or two or more of polysaccharide derivatives having one or more groups selected from a cationic group and a hydrocarbon group with 8 or more and 14 or less carbons, the polysaccharide derivatives having at least a hydrocarbon group with 8 or more and 14 or less carbons;

component (b2): one or two or more of polymers having one or two units selected from an alkylene terephthalate unit and an alkylene isophthalate unit, and an oxyalkylene unit; and component (b3): one or two or more of polyalkyleneimine polymers having a polyoxyalkylene group.

2. The detergent composition for textile products according to claim 1, wherein a content of an α-olefin sulfonate in the internal olefin sulfonate of the component (A) is 10% by mass or less and 0.01% by mass or more.

3. The detergent composition for textile products according to claim 1, wherein a proportion of the component (A) in the total anionic surfactants contained in the detergent composition for textile products is 50% by mass or more and 100% by mass or less.

4. The detergent composition for textile products according to claim 1, wherein the component (b1) is a polysaccharide derivative in which one or more groups selected from a cationic group and a hydrocarbon group with 8 or more and 14 or less carbons are bonded, directly or via a linking group, to a group lacking a hydrogen atom of a hydroxyl group of a polysaccharide or a derivative thereof, which is a precursor compound; and when the cationic group is bonded to the group lacking a hydrogen atom of a hydroxyl group, it is bonded thereto directly or via a linking group (2), and when the hydrocarbon group is bonded to the group lacking a hydrogen atom of a hydroxyl group, it is bonded thereto directly or via a linking group (1), wherein the linking group (1) is one or more groups selected from: an alkyleneoxy group with 1 or more and 3 or less carbons which may have a hydroxy group; a polyoxyalkylene group in which the alkylene group is an alkylene group with 1 or more and 3 or less carbons; a carbonyl group; a carbonyloxy group; and an oxycarbonyl group; and the linking group (2) is an alkylene group with 1 or more and 4 or less carbons which may include a hydroxy group.

5. The detergent composition for textile products according to claim 4, wherein the polysaccharide is one or more polysaccharides selected from cellulose, guar gum or starch.

6. The detergent composition for textile products according to claim 1, wherein in the polysaccharide derivative of the component (b1) having a hydrocarbon group with 8 or more and 14 or less carbons, a substitution degree of the hydrocarbon group with 8 or more and 14 or less carbons is 0.0001 or more and 0.4 or less.

7. The detergent composition for textile products according to claim 1, wherein in the polysaccharide derivative of the component (b1) having a cationic group, a substitution degree of the cationic group is 0.001 or more and 0.4 or less.

8. The detergent composition for textile products according to claim 1, wherein a weight average molecular weight of a polysaccharide or a derivative thereof, which is a precursor compound of the component (b1), is 1,000 or more and 3 million or less.

9. The detergent composition for textile products according to claim 1, wherein the component (B) is one or two or more of polysaccharide derivatives having one or more groups selected from a hydrocarbon group with 8 or more and 14 or less carbons and a cationic group.

10. The detergent composition for textile products according to claim 1, wherein the detergent composition for textile products is a detergent composition (1) for textile products used by diluting in water; and a content of the component (A) in the detergent composition (1) for textile products is 5% by mass or more and 50% by mass or less and a content of the component (B) therein is 0.1% by mass or more and 10% by mass or less.

11. The detergent composition for textile products according to claim 1, wherein the detergent composition for textile products is a detergent composition (2) for textile products used as a detergent liquid as-is without diluting; and a content of the component (A) in the detergent composition (2) for textile products is 0.005% by mass or more and 1% by mass or less and a content of the component (B) therein is 0.1 mg/kg or more and 800 mg/kg or less.

12. The detergent composition for textile products according to claim 1, comprising water.

13. The detergent composition for textile products according to claim 1, further comprising a nonionic surfactant as a component (C).

14. The detergent composition for textile products according to claim 13, wherein the component (C) is a nonionic surfactant having one or more groups selected from a hydroxyl group and a polyoxyalkylene group.

15. The detergent composition for textile products according to claim 13, wherein the component (C) is a nonionic surfactant having a polyoxyalkylene group and having an HLB of 7 or more and 20 or less.

16. The detergent composition for textile products according to claim 13, wherein the component (C) is a nonionic surfactant having an HLB of 7 or more and 20 or less and represented by the following general formula (C):

$$R^1(CO)_mO—(A^1O)_n—R^2 \quad (C)$$

wherein $R^1$ is an aliphatic hydrocarbon group with 9 or more and 16 or less carbons; $R^2$ is a hydrogen atom or a methyl group; CO is a carbonyl group; m is a number of 0 or 1; $A^1O$ group is one or more groups selected from an ethyleneoxy group and a propyleneoxy group; and n is an average number of added moles and is a number of 3 or more and 50 or less.

17. The detergent composition for textile products according to claim 13, wherein a content of the component (C) in the detergent composition for textile products is 1% by mass or more and 60% by mass or less.

18. The detergent composition for textile products according to claim 13, wherein a mass ratio (C)/(B) of a content of the component (C) to a content of the component (B) is 2 or more and 100 or less.

19. A method for washing textile products, comprising washing textile products with a detergent liquid containing the detergent composition for textile products according to claim 1 and water, wherein a content of the component (A) in the detergent liquid is 0.005% by mass or more and 1% by mass or less and a content of the component (B) in the detergent liquid is 0.1 mg/kg or more and 800 mg/kg or less.

* * * * *